US010680307B2

(12) United States Patent
Watanabe et al.

(10) Patent No.: US 10,680,307 B2
(45) Date of Patent: Jun. 9, 2020

(54) WAVEGUIDE TO STRIP LINE TRANSDUCER INCLUDING A WAVEGUIDE WALL FORMING SUBSTRATE HAVING AN END SURFACE BONDED TO A SECOND CONDUCTOR, AND A POWER FEED CIRCUIT FORMED THEREFROM

(71) Applicant: Mitsubishi Electric Corporation, Chiyoda-ku (JP)

(72) Inventors: Motomi Watanabe, Chiyoda-ku (JP); Shinji Arai, Chiyoda-ku (JP); Tomohiro Takahashi, Chiyoda-ku (JP); Takeshi Oshima, Chiyoda-ku (JP); Takeshi Yuasa, Chiyoda-ku (JP); Takuma Nishimura, Chiyoda-ku (JP); Hidenori Yukawa, Chiyoda-ku (JP)

(73) Assignee: Mitsubishi Electric Coporation, Chiyoda-ku (JP)

( * ) Notice: Subject to any disclaimer, the term of this patent is extended or adjusted under 35 U.S.C. 154(b) by 0 days.

(21) Appl. No.: 16/308,585

(22) PCT Filed: Jun. 5, 2017

(86) PCT No.: PCT/JP2017/020813
§ 371 (c)(1),
(2) Date: Dec. 10, 2018

(87) PCT Pub. No.: WO2018/029953
PCT Pub. Date: Feb. 15, 2018

(65) Prior Publication Data

US 2019/0157735 A1 May 23, 2019

(30) Foreign Application Priority Data

Aug. 12, 2016 (WO) ..... PCT/2016/073720

(51) Int. Cl.
*H01P 5/12* (2006.01)
*H01P 5/107* (2006.01)
(Continued)

(52) U.S. Cl.
CPC ..... *H01P 5/12* (2013.01); *H01P 1/17* (2013.01); *H01P 3/123* (2013.01); *H01P 5/02* (2013.01);
(Continued)

(58) Field of Classification Search
CPC .. H01P 5/103; H01P 5/107; H01P 1/17; H01P 5/12
(Continued)

(56) References Cited

U.S. PATENT DOCUMENTS 4,608,713 A * 8/1986 Shiomi et al. ..... H03D 9/0641 333/21 R
4,623,848 A * 11/1986 Saka et al. ..... H03F 3/60 330/277
(Continued)

FOREIGN PATENT DOCUMENTS

JP 59-40702 3/1984
JP 1-174102 A 7/1989
(Continued)

OTHER PUBLICATIONS

International Search Report dated Aug. 1, 2017 in PCT/JP2017/020813 filed on Jun. 5, 2017.
(Continued)

*Primary Examiner* — Benny T Lee
(74) *Attorney, Agent, or Firm* — Oblon, McClelland, Maier & Neustadt, L.L.P.

(57) ABSTRACT

A substrate is used as one tube wall of a hollow waveguide, the substrate including a strip line wired in an inner layer, a first ground surface formed on a front surface, and a second
(Continued)

ground surface formed on a part of a back surface. As a result of such a configuration, a waveguide strip line transducer having the same dimension as the external dimension of the hollow waveguide can be obtained.

13 Claims, 15 Drawing Sheets

(51) Int. Cl.

| | |
|---|---|
| ***H01P 1/17*** | (2006.01) |
| ***H01P 5/103*** | (2006.01) |
| ***H01P 3/123*** | (2006.01) |
| ***H01P 5/02*** | (2006.01) |
| ***H01P 5/16*** | (2006.01) |

(52) U.S. Cl.
CPC ..... *H01P 5/103* (2013.01); *H01P 5/107* (2013.01); *H01P 5/16* (2013.01)

(58) Field of Classification Search
USPC ..... 333/26, 21 A, 125
See application file for complete search history.

(56) References Cited

U.S. PATENT DOCUMENTS

| | | | | |
|---|---|---|---|---|
| 4,679,249 | A * | 7/1987 | Tanaka et al. ..... | H01P 5/107 333/21 R |
| 4,754,239 | A | 6/1988 | Sedivec | |
| 5,475,394 | A | 12/1995 | Kohls et al. | |

FOREIGN PATENT DOCUMENTS

| | | | |
|---|---|---|---|
| JP | 2-58906 | A | 2/1990 |
| JP | 2-280503 | A | 11/1990 |
| JP | 8-213804 | A | 8/1996 |
| JP | 2002-344210 | A | 11/2002 |
| JP | 2007-318322 | A | 12/2007 |
| JP | 2008-167246 | A | 7/2008 |
| JP | 2010-263285 | A | 11/2010 |

OTHER PUBLICATIONS

Extended European Search Report dated Aug. 6, 2019 in European Patent Application No. 17839028.2, 9 pages.
European Office Action dated Oct. 30, 2019 in European Patent Application No. 17 839 028.2, 6 pages.

* cited by examiner

Diagram as Viewed from A in Fig. 5

Diagram as Viewed from B in Fig. 5

Diagram as Viewed from C in Fig. 5

Diagram as Viewed from A in Fig. 8

Diagram as Viewed from B in Fig. 8

WAVEGUIDE TO STRIP LINE TRANSDUCER INCLUDING A WAVEGUIDE WALL FORMING SUBSTRATE HAVING AN END SURFACE BONDED TO A SECOND CONDUCTOR, AND A POWER FEED CIRCUIT FORMED THEREFROM

TECHNICAL FIELD

The present invention relates to a waveguide strip line transducer for inputting and outputting an electromagnetic wave and a power feed circuit on which the waveguide strip line transducer is mounted.

BACKGROUND ART

The Patent Literature 1 listed below discloses a waveguide strip line transducer for transducing a transmission mode of an electromagnetic wave such as a microwave or a millimeter wave, for example.

The waveguide strip line transducer includes a hollow waveguide having a rectangular cross-sectional shape.

A substrate is provided on the upper side of one tube wall among four tube walls forming the hollow waveguide, and a strip line is wired on a front surface of the substrate.

In addition, a hole is provided in the one tube wall on which the substrate is provided, and a probe connected to the strip line is arranged at the position of the hole provided in the one tube wall such that an end of the probe is at a position of the tube interior in the hollow waveguide.

Note that, in a power feed circuit for feeding power to a plurality of antenna elements forming an array antenna, generally, the same number of waveguide strip line transducers as the number of the plurality of antenna elements is mounted.

CITATION LIST

Patent Literature

Patent literature 1: JP S59-40702 A (JP 1984-40702 A)

SUMMARY OF THE INVENTION

Technical Problem

In the conventional waveguide strip line transducer, a substrate is provided on the upper side of the one tube wall among the four tube walls forming the hollow waveguide. For this reason, the external dimension of the waveguide strip line transducer is a dimension of a combination of the external dimension of the hollow waveguide and that of the substrate, and there has been a problem that the external dimension of the waveguide strip line transducer becomes larger than the external dimension of the hollow waveguide.

Therefore, in the power feed circuit for feeding power to the plurality of antenna elements, when a plurality of the waveguide strip line transducers is mounted, it is necessary to mount the plurality of waveguide strip line transducers in consideration not only of the external dimension of the hollow waveguide but also of the external dimension of the substrate. For this reason, as compared with a case where the substrate is not mounted, an interval between the waveguide strip line transducers becomes wider, and a footprint of the array antenna may become larger.

The present invention has been made to solve the problem described above, and an object of the present invention is to obtain a waveguide strip line transducer having the same dimension as the external dimension of the hollow waveguide.

In addition, another object of the present invention is to obtain a power feed circuit on which the above-described waveguide strip line transducer is mounted.

Solution to the Problem

A waveguide strip line transducer according to the present invention includes: a substrate including a strip line wired in an inner layer of the substrate, a first ground surface formed on a front surface of the substrate, and a second ground surface formed on a part of a back surface of the substrate; a hollow waveguide having a rectangular cross-sectional shape formed by four tube walls, the substrate forming one tube wall of the four tube walls; a via hole having one end connected to the strip line, and another end arranged on a non-ground surface being a part of the back surface of the substrate on which the second ground surface is not formed; and a probe having one end connected to the another end of the via hole, and another end arranged at a position in a tube interior of the hollow waveguide.

Advantageous Effects of the Invention

According to the present invention, a substrate includes a strip line wired in an inner layer of the substrate, a first ground surface formed on a front surface of the substrate, and a second ground surface formed on a part of a back surface of the substrate. The substrate is used as one tube wall of a hollow waveguide. As a result of such a configuration, there is an effect that a waveguide strip line transducer having the same dimension as the external dimension of the hollow waveguide can be obtained.

DETAILED DESCRIPTION OF THE EMBODIMENTS

Hereinafter, in order to explain the present invention in more detail, some embodiments for carrying out the present invention will be described with reference to the accompanying drawings where like features in different drawing figures are denoted by the same reference number.

First Embodiment

Figure 1A:
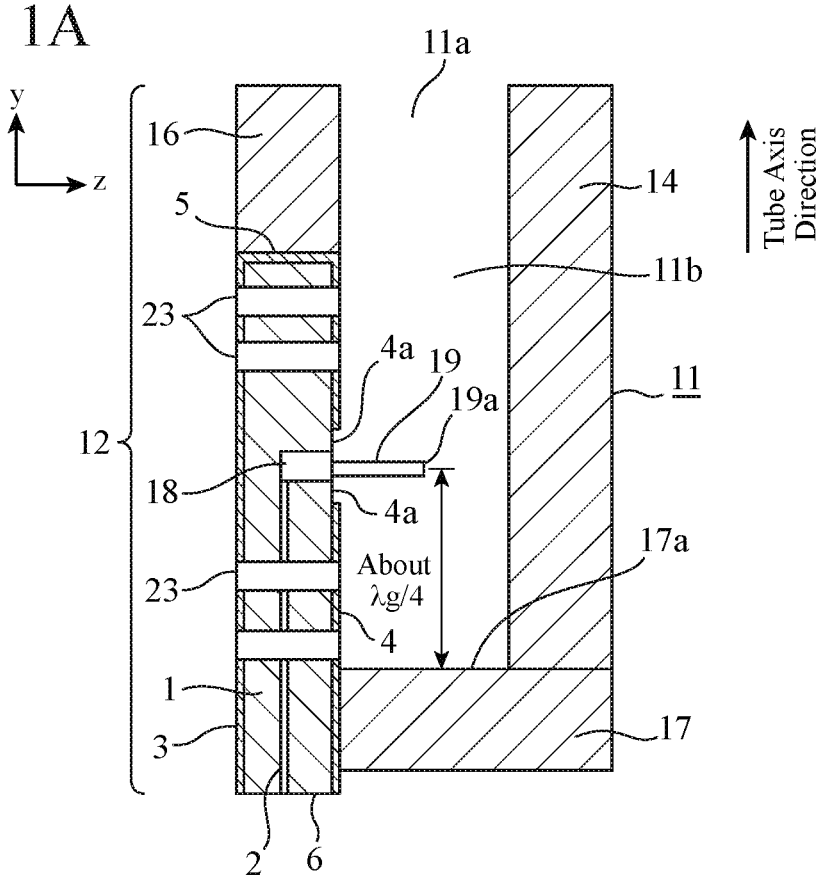
FIG. 1A is a cross-sectional view illustrating a waveguide strip line transducer according to a first embodiment of the present invention.
Figure 1B:
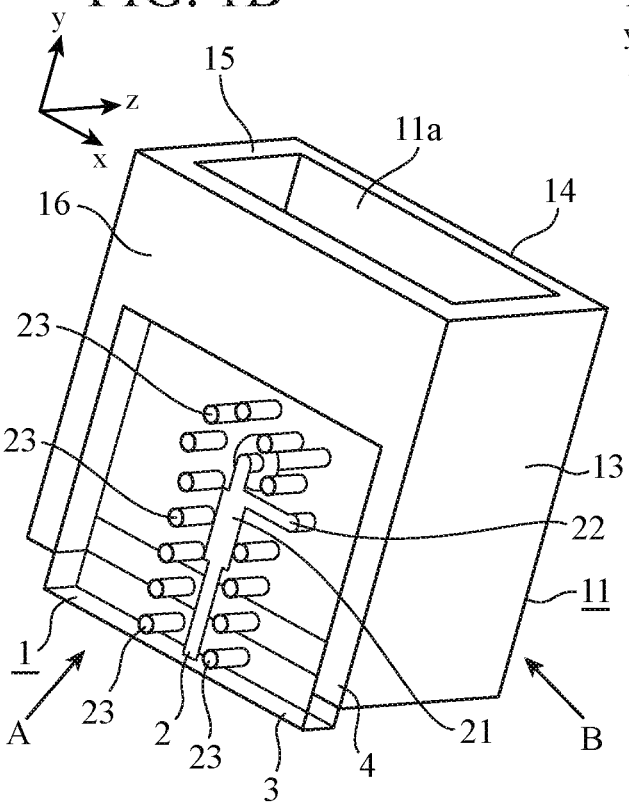
FIG. 1B is a transparent perspective view illustrating the waveguide strip line transducer according to the first embodiment of the present invention.
Figure 1C:
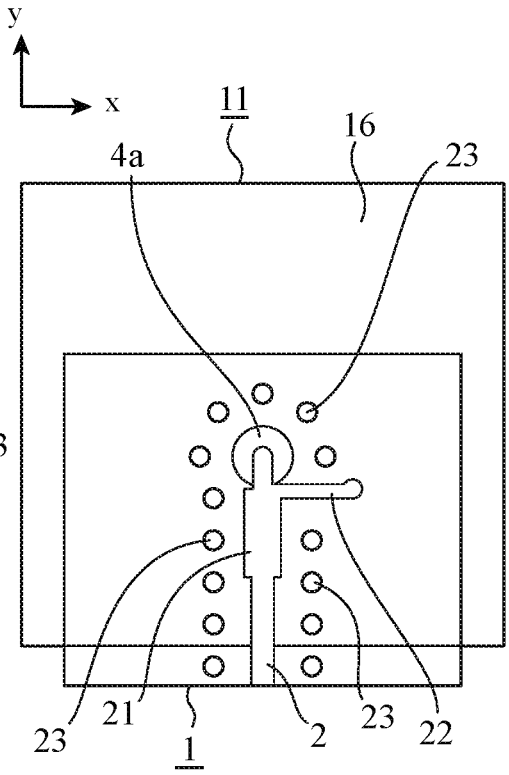
FIG. 1C is a transparent view illustrating the waveguide strip line transducer according to the first embodiment of the present invention.

FIGS. 1A, 1B and 1C are a configuration diagram illustrating a waveguide strip line transducer according to a first embodiment of the present invention.

FIG. 1A is a cross-sectional view illustrating a waveguide strip line transducer according to a first embodiment of the present invention, FIG. 1B is a transparent perspective view illustrating the waveguide strip line transducer according to the first embodiment of the present invention, and FIG. 1C is a transparent view illustrating the waveguide strip line transducer according to the first embodiment of the present invention.

In FIGS. 1A, 1B and 1C, a substrate 1 includes a strip line 2 wired in an inner layer thereof, a first ground surface 3 (see FIGS. 1A and 1B) formed on a front surface thereof and a second ground surface 4 (see FIGS. 1A and 1B) formed on a part of a back surface thereof.

Out of end surfaces 5 and 6 (see FIG. 1A) of the substrate 1 in a tube axis direction of a hollow waveguide 11, that is, out of the end surfaces 5 and 6 (see FIG. 1A) of the substrate 1 in the y direction, the end surface 5 (see FIG. 1A) on an opening side 11*a* of the hollow waveguide 11 is shielded by a conductor.

A conductor 16 is bonded to the end surface 5 (see FIG. 1A) of the substrate 1 shielded by the conductor, and the conductor 16 and the substrate 1 form one tube wall 12 of the hollow waveguide 11.

The hollow waveguide 11 has a rectangular cross-sectional shape, and includes four tube walls 12, 13, 14, and 15 forming the cross-sectional shape.

In the hollow waveguide 11, the substrate 1 is used as a part of the tube wall 12 among the four tube walls 12, 13, 14, and 15.

In addition, the hollow waveguide 11 is a waveguide in which one tube opening of its two tube openings is closed with a conductor 17.

A back short 17*a* is a surface of the conductor 17 in a tube interior 11*b*.

A blind via hole (hereinafter referred to as "BVH") 18 has one end connected to the strip line 2 and another end arranged on a non-ground surface 4*a* (see FIGS. 1A and 1C) on the back surface of the substrate 1 on which the second ground surface 4 is not formed.

A probe 19 transmits and receives an electromagnetic wave, and one end thereof is connected to the other end of the BVH 18, and a tip 19*a* that is another end of the probe 19 is arranged at a position of the tube interior 11*b* in the hollow waveguide 11.

A matching element includes an impedance transforming unit 21 and a short-circuit stub 22, and is provided for adjusting an input impedance or an output impedance of the probe 19.

The matching element is connected to the strip line 2 in the region between a position where the BVH 18 is provided and a position where the back short 17*a* is provided in the whole strip line 2.

The impedance transforming unit 21 in the matching element is a conductor for widening a line width of the strip line 2 to adjust a resistance component in the input impedance or the output impedance of the probe 19.

The short-circuit stub 22 in the matching element is a conductor whose one end is connected to the strip line 2 and another end is short-circuited.

Via holes 23 (see FIG. 2A) are arranged around the strip line 2 to prevent leakage of electromagnetic waves.

One end of each of the via holes 23 (see FIG. 2A) is connected to the first ground surface 3 (see FIGS. 1A and 1B), and another end of each of the via holes 23 (see FIG. 2A) is connected to the second ground surface 4.

FIGS. 1A, 1B and 1C illustrate an example in which fifteen via holes 23 (see FIG. 2A) are mounted; however, the number of via holes 23 (see FIG. 2A) is not limited to fifteen. Actually, it is assumed that fifteen or more via holes 23 (see FIG. 2A) are mounted to prevent the leakage of electromagnetic waves with high accuracy.

Next, an operation will be described.

The hollow waveguide 11 in the waveguide strip line transducer of FIGS. 1A, 1B and 1C includes the four tube walls 12, 13, 14, and 15.

Among the four tube walls 12, 13, 14, and 15, a part of one tube wall 12 is formed by the substrate 1.

Since the first ground surface 3 (see FIGS. 1A and 1B) is formed on the front surface of the substrate 1 and the second ground surface 4 is formed on the back surface of the substrate 1, the substrate 1 functions as the tube wall 12 of the hollow waveguide 11.

The conductor 16 is bonded to the end surface 5 (see FIG. 1A) of the substrate 1 shielded by the conductor 16 by, for example, a conductive bonding agent, a conductive screw, or the like, and the conductor 16 and the substrate 1 form the one tube wall 12 in the hollow waveguide 11.

The strip line 2 is wired in an inner layer of the substrate 1.

One end of the strip line 2 is at a position of the end surface 6 (see FIG. 1A) in the y direction in the substrate 1, and another end of the strip line 2 is connected to the BVH 18.

Since one end of the probe 19 is connected to the BVH 18, the probe 19 is electrically connected to the strip line 2 via the BVH 18. As the connection between the probe 19 and the BVH 18, for example, bonding that uses soldering or the like can be considered.

The tip 19*a* of the probe 19 is arranged at the position of the tube interior 11*b* in the hollow waveguide 11.

Assuming that a tube interior wavelength is λg at the center frequency of a desired band, the tip 19*a* of the probe 19 is arranged at, for example, a position where a distance between the center of the tip 19*a* of the probe 19 and the back short 17*a* is about λg/4.

For example, in a case where an electromagnetic wave is radiated from an antenna element arranged on the opening side 11*a* of the hollow waveguide 11, an electromagnetic wave incident from one end of the strip line 2 is radiated from the tip 19*a* of the probe 19.

The electromagnetic wave radiated from the tip 19*a* of the probe 19 is divided into an electromagnetic wave traveling toward the opening side 11*a* of the hollow waveguide 11 and an electromagnetic wave traveling toward the back short 17*a*.

The electromagnetic wave traveling toward the back short 17*a* side is reflected by the back short 17*a* and then travels toward the opening side 11*a* of the hollow waveguide 11.

In the first embodiment, the tip 19*a* of the probe 19 is arranged at a position where the distance between the center of the tip 19*a* of the probe 19 and the back short 17*a* is about λg/4. As a result, the phase of the electromagnetic wave reflected by the back short 17*a* and traveling toward the opening side 11*a* of the hollow waveguide 11 and the phase of the electromagnetic wave radiated from the tip 19*a* of the probe 19 and directly traveling toward the opening side 11*a* of the hollow waveguide 11 are in-phase.

As a result, both electromagnetic waves interfere with and intensify each other, so that a large power electromagnetic wave can be supplied to the antenna element.

In the first embodiment, the matching element including the impedance transforming unit 21 and the short-circuit stub 22 is connected to the strip line 2 to enable transmission and reception of the electromagnetic wave from the antenna element in a broadband.

Hereinafter, functions of the impedance transforming unit 21 and the short-circuit stub 22 will be described.

The input impedance of the probe 19 in a case where an electromagnetic wave is radiated from the antenna element, or the output impedance of the probe 19 in a case where the antenna element receives an electromagnetic wave varies depending on the length of the probe 19. Hereinafter, the length of the probe 19 is referred to as the insertion length into the hollow waveguide 11.

Therefore, in the first embodiment, it is assumed that when the waveguide strip line transducer of FIGS. 1A, 1B and 1C is designed, the insertion length is selected to minimize a reactance component in the input impedance or the output impedance of the probe 19, and the probe 19 is provided to have the selected insertion length.

The impedance transforming unit 21 in the matching element is a conductor for widening the line width of the strip line 2, and enables adjustment of the resistance component in the input impedance or the output impedance of the probe 19.

Therefore, when the waveguide strip line transducer of FIGS. 1A, 1B and 1C is designed, by designing the line width of the strip line 2 appropriately, the resistance component in the input impedance or the output impedance of the probe 19 can be adjusted to an appropriate value.

As a result, an impedance of an external circuit, which is not illustrated, connected to the strip line 2 can be matched with the input impedance or the output impedance of the probe 19. However, only by adjusting the line width of the strip line 2 in the impedance transforming unit 21, it is only one point matching in the vicinity of the center frequency of the desired band, so that it is difficult to widen a band of the electromagnetic wave that can be transmitted and received by the antenna element.

In the first embodiment, since the short-circuit stub 22 is connected to the strip line 2 in addition to the impedance transforming unit 21, the band of an electromagnetic wave in which the antenna element can transmit and receive the electromagnetic wave can be widened.

By connecting the short-circuit stub 22 to the strip line 2, the reactance component at the band edge can be substantially reversed in the positive and negative signs, so that two matching points can be provided.

As a result, the antenna element can transmit and receive an electromagnetic wave in a broadband as compared with a case where only the impedance transforming unit 21 is connected as the matching element.

Figure 2A:
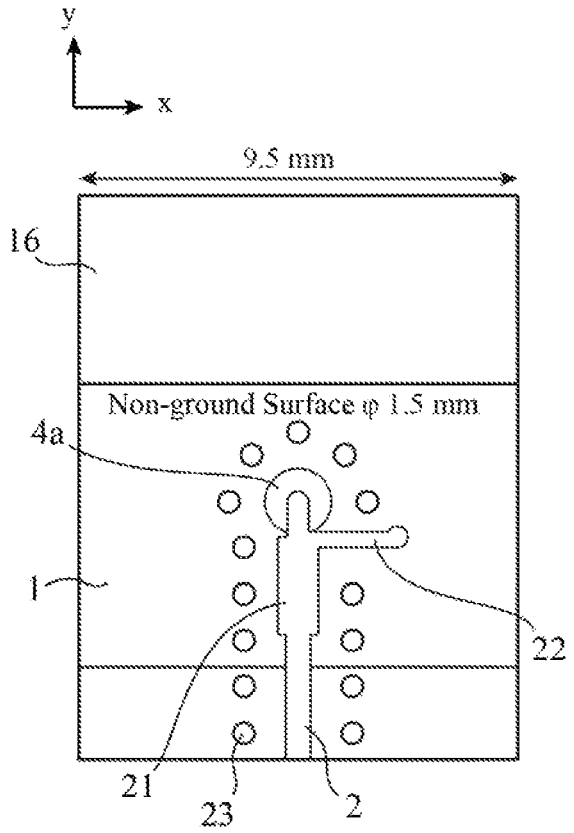
FIG. 2A is a transparent view illustrating a design example of the waveguide strip line transducer as viewed from direction A in FIG. 1B.
Figure 2B:
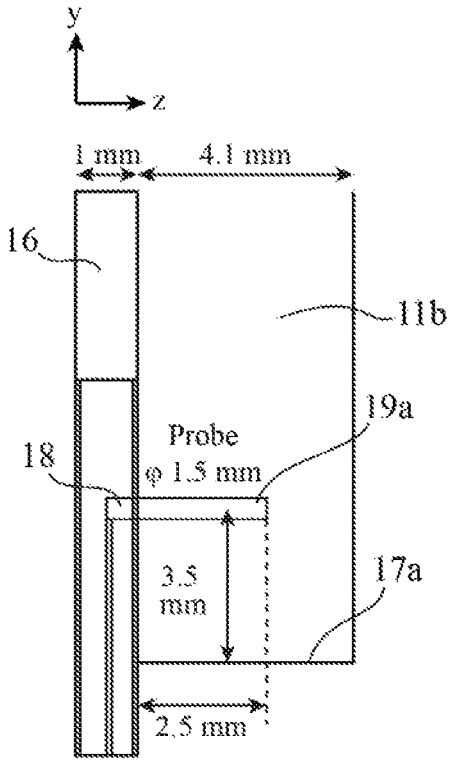
FIG. 2B is a transparent view illustrating a design example of the waveguide strip line transducer as viewed from direction B in FIG. 1B.

FIGS. 2A and 2B are a transparent view illustrating a design example of the waveguide strip line transducer according to the first embodiment of the present invention.

FIG. 2A is a transparent view illustrating a design example of the waveguide strip line transducer as viewed from direction A in FIG. 1B, and FIG. 2B is a transparent view illustrating a design example of the waveguide strip line transducer as viewed from direction B in FIG. 1B. In FIG. 2B, the description of the via holes 23 (see FIG. 2A) is omitted for simplicity of the drawing.

In the design example of FIGS. 2A and 2B, the dimension in the x direction (see FIG. 2A) of the substrate 1 is 9.5 mm and the dimension in the z direction (see FIG. 2B) of the substrate 1 is 1 mm.

The dimension in the z direction of the tube interior 11*b* in the hollow waveguide 11 is 4.1 mm as shown in FIG. 2B.

The distance dimension between the center of the tip 19*a* of the probe 19 and the back short 17*a* is 3.5 mm (see FIGS. 1A and 2B), and the insertion length of the probe 19 is 2.5 mm (see FIGS. 1A and 2B).

The diameter ϕ of the non-ground surface 4*a* (see FIG. 2A) is 1.5 mm, and the diameter ϕ of the probe 19 is 0.5 mm as shown in FIG. 2B.

Figure 3:
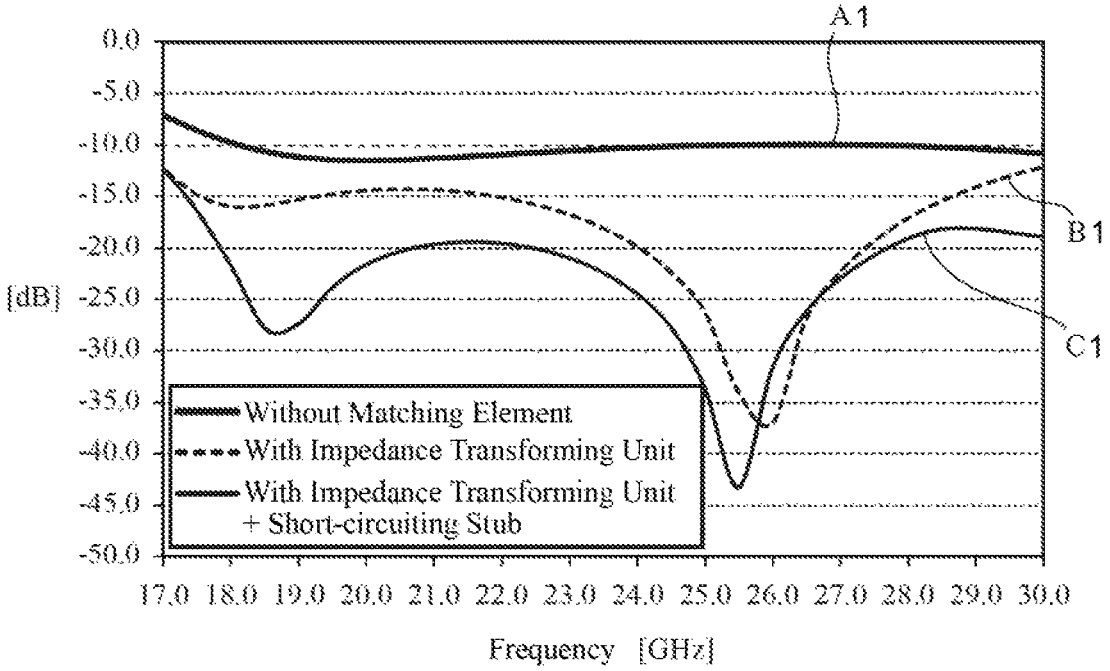
FIG. 3 is an explanatory diagram illustrating reflection characteristics in the waveguide strip line transducer of FIGS. 2A and 2B.

FIG. 3 is an explanatory diagram illustrating reflection characteristics in dB vs. Frequency in GHz in the waveguide strip line transducer of FIGS. 2A and 2B.

The reflection characteristics illustrated in FIG. 3 are calculated by, for example, simulations.

In FIG. 3. A1 indicates reflection characteristics in a case where the matching element is not connected to the strip line 2.

B1 indicates reflection characteristics in a case where only the impedance transforming unit 21 is connected as a matching element to the strip line 2, and C1 indicates reflection characteristics in a case where the impedance transforming unit 21 and the short-circuit stub 22 are connected (i.e. without matching element) as a matching element to the strip line 2.

In the case where only the impedance transforming unit 21 is connected as the matching element to the strip line 2, since matching is made even only at one point, the reflection characteristics are better than in the case where no matching element is connected to the strip line 2, as illustrated in FIG. 3.

In the case where not only the impedance transforming unit 21 but also the short-circuit stub 22 is connected to the strip line 2, since matching is made at two points, the reflection characteristics are better than in the case where only the impedance transforming unit 21 is connected to the strip line 2, as illustrated in FIG. 3.

In the case where not only the impedance transforming unit 21 but also the short-circuit stub 22 is connected to the strip line 2, preferable reflection characteristics of −19 dB or less are obtained in many band regions within the desired band, as illustrated in C1 in FIG. 3.

As is apparent from the above description, according to the first embodiment, a substrate 1 includes a strip line 2 wired in an inner layer of the substrate 1, a first ground surface 3 (see FIGS. 1A and 1B) formed on a front surface of the substrate 1, and a second ground surface 2 formed on a part of a back surface of the substrate 1. The substrate 1 is used as one tube wall 12 of the hollow waveguide 11. As a result, there is an effect that a waveguide strip line transducer having the same dimension as the external dimension of the hollow waveguide 11 can be obtained.

That is, according to the first embodiment, out of the end surfaces 5 and 6 (see FIG. 1A) of the substrate 1 in the y direction, the end surface 5 (see FIG. 1A) on the opening side 11*a* of the hollow waveguide 11 is shielded by the conductor, the conductor 16 is bonded to the end surface 5 (see FIG. 1A) of the substrate 1 shielded by the conductor 16, and the conductor 16 and the substrate 1 bonded to each other form the one tube wall 12 of the hollow waveguide 11, so that the substrate 1 becomes a part of the tube wall 12 of the hollow waveguide 11, and the waveguide strip line transducer having the same dimension as the external dimension of the hollow waveguide 11 can be obtained. As a result, no space for arranging the substrate 1 separately from the hollow waveguide 11 is required, and the external dimension of the waveguide strip line transducer can be made smaller than that in a case where the substrate is provided on the upper side of one tube wall.

In addition, according to the first embodiment, the matching element for adjusting the input impedance or the output impedance of the probe 19 is connected to the strip line 2, so that there is an effect that the impedance of the external circuit (not illustrated) connected to the strip line 2 can be matched with the input impedance or the output impedance of the probe 19.

In addition, according to the first embodiment, the matching element is connected to the strip line 2 in the region between the position where the BVH 18 is provided and the position where the back short 17*a* is provided in the whole strip line 2, so that there is an effect that impedance matching can be made without an increase of the dimension in the y direction that is the tube axis direction of the hollow waveguide 11.

According to the first embodiment, the matching element includes the impedance transforming unit 21 for widening the line width of the strip line 2, and the short-circuit stub 22 having one end connected to the strip line 2 and the other end short-circuited, so that there is an effect that the band of an electromagnetic wave in which the antenna element can transmits and receives the electromagnetic wave can be widened.

In the first embodiment, the end surface 5 (see FIG. 1A) of the substrate 1 shielded by a conductor is bonded to the conductor 16, and the conductor 16 and the substrate 1 form the one tube wall 12 of the hollow waveguide 11.

Figure 4:
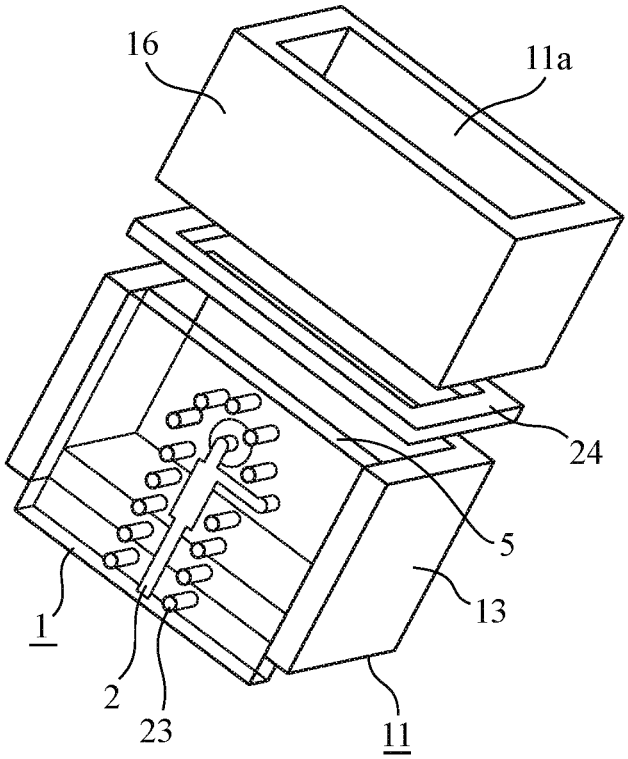
FIG. 4 is an exploded view illustrating another waveguide strip line transducer according to the first embodiment of the present invention.

To enhance bonding accuracy between the conductor 16 and the substrate 1, as illustrated in FIG. 4, a conductor plate 24 having the same cross-sectional shape as the hollow waveguide 11 may be provided to be sandwiched between the conductor 16 and the substrate 1.

FIG. 4 is an exploded view illustrating another waveguide strip line transducer according to the first embodiment of the present invention.

In the first embodiment, an example is described in which the strip line 2 is wired in the inner layer of the substrate 1; however, the first embodiment is not limited to such an example. For example, a microstrip line may be wired in the inner layer of the substrate 1, and also in such a configuration, a similar effect can be obtained.

Second Embodiment

In the first embodiment, the waveguide strip line transducer in which the substrate 1 is used as the one tube wall 12 in the hollow waveguide 11 is described.

In a second embodiment, a power feed circuit on which the waveguide strip line transducer of FIGS. 1A, 1B and 1C in the first embodiment is mounted will be described.

Figure 5:
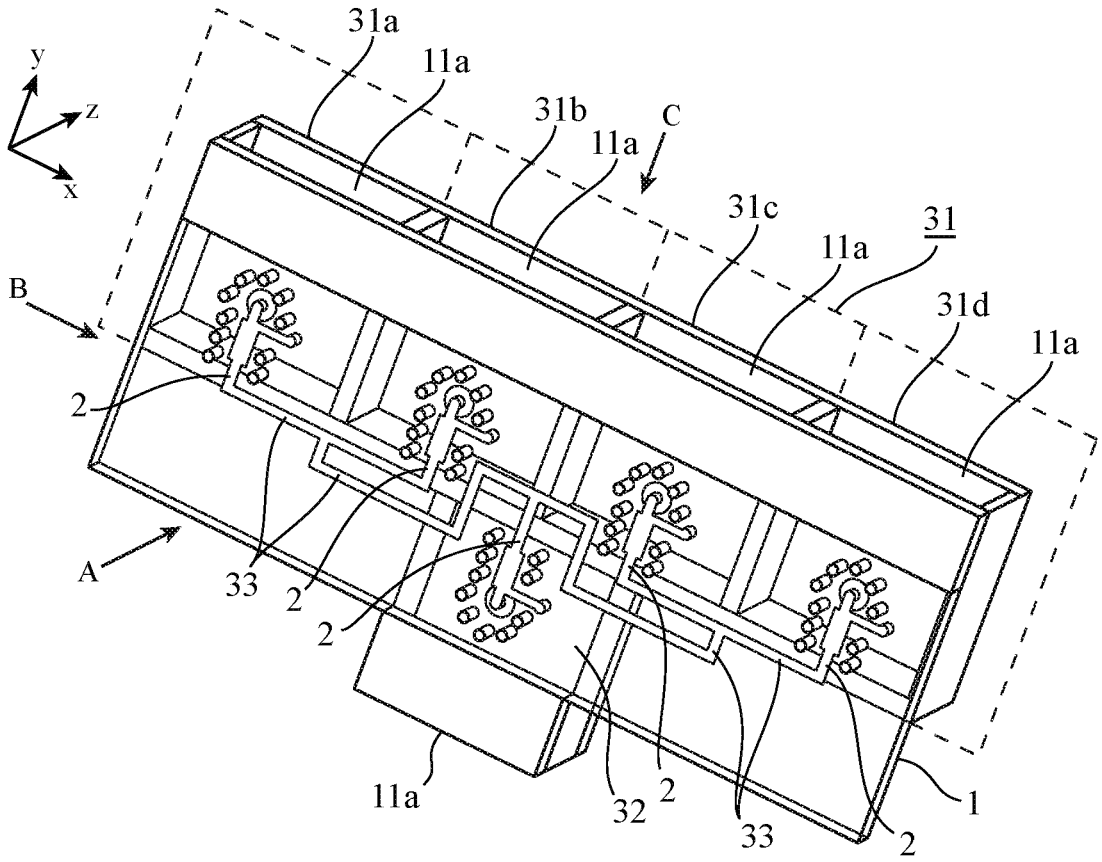
FIG. 5 is a transparent perspective view illustrating a power feed circuit according to a second embodiment of the present invention.

FIG. 5 is a transparent perspective view illustrating a power feed circuit according to the second embodiment of the present invention. In FIG. 5, the same reference numerals as those in FIGS. 1A, 1B and 1C denote the same or corresponding portions, so that the description thereof will be omitted.

In FIG. 5, a first transducer group 31 includes waveguide strip line transducers 31*a*, 31*b*, 31*c*, and 31*d*.

Each of the waveguide strip line transducers 31*a*, 31*b*, 31*c*, and 31*d* is the same waveguide strip line transducer as that shown in FIGS. 1A, 1B and IC.

The first transducer group 31 may include any number of two or more waveguide strip line transducers. In FIG. 5, four waveguide strip line transducers are included in the first transducer group 31 as an example.

A waveguide strip line transducer 32 that is a second transducer is the same waveguide strip line transducer as that shown in FIGS. 1A, 1B and 1C, and in the figure, its orientation in the y direction is opposite to the orientation of each of the waveguide strip line transducers 31*a*, 31*b*, 31*c*, and 31*d*.

Therefore, the opening 11*a* of the hollow waveguide 11 (shown in FIG. 1A) in each of the waveguide strip line transducers 31*a*, 31*b*, 31*c*, and 31*d* is in the y direction, and the opening 11*a* of the hollow waveguide 11 in the waveguide strip line transducer 32 is in the opposite of the y direction.

A synthesizing and distributing circuit 33 connects the strip lines 2 of the waveguide strip line transducers 31*a*, 31*b*, 31*c*, and 31*d* included in the first transducer group 31 and the strip line 2 of the waveguide strip line transducer 32 to each other.

The substrate 1 is shared by the waveguide strip line transducers 31*a*, 31*b*, 31*c*, and 31*d* and the waveguide strip line transducer 32, and the strip lines 2 of the waveguide strip line transducers 31*a*, 31*b*, 31*c*, and 31*d* and the strip line 2 of the waveguide strip line transducer 32 are wired in the inner layer of the substrate 1. In addition, the synthesizing and distributing circuit 33 is wired in the inner layer of the substrate 1.

Figure 6A:
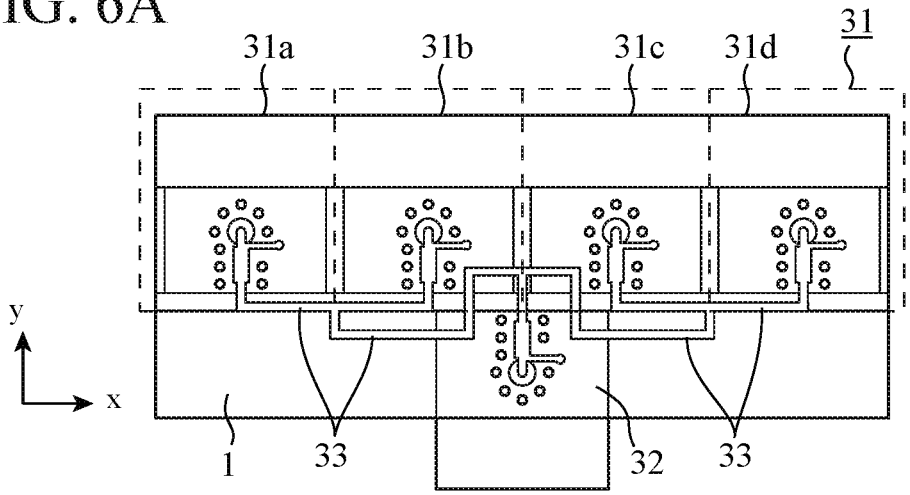
FIG. 6A is a transparent view illustrating the power feed circuit as viewed from direction A in FIG. 5.
Figure 6B:
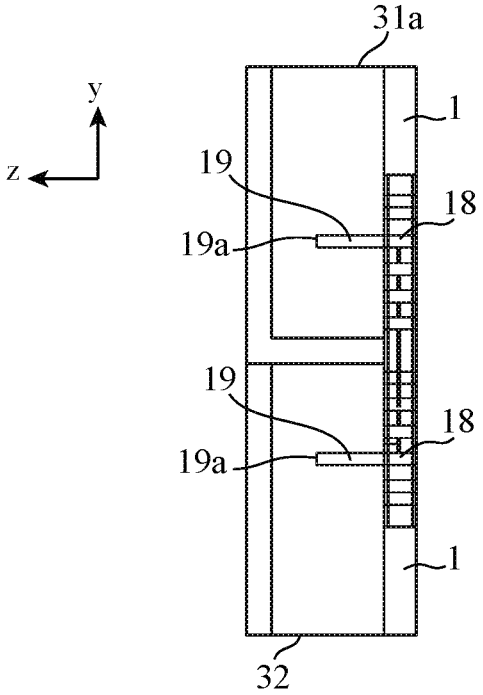
FIG. 6B is a transparent view illustrating the power feed circuit as viewed from direction B in FIG. 5.
Figure 6C:
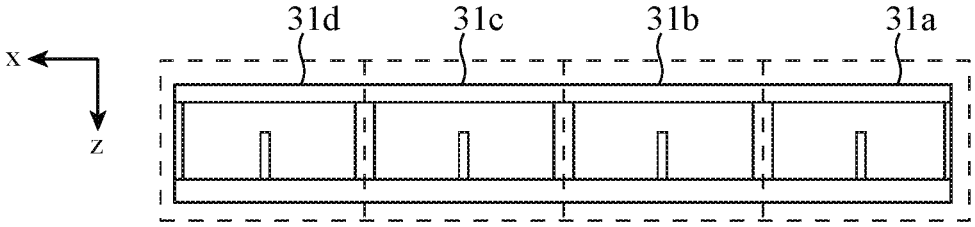
FIG. 6C is a transparent view illustrating the power feed circuit as viewed from direction C in FIG. 5.

FIGS. 6A, 6B and 6C are an explanatory diagram illustrating the power feed circuit according to the second embodiment of the present invention.

FIG. 6A is a transparent view illustrating the power feed circuit as viewed from direction A in FIG. 5. FIG. 6B is a transparent view illustrating the power feed circuit as viewed from direction B in FIG. 5, and FIG. 6C is a transparent view illustrating the power feed circuit as viewed from direction C in FIG. 5.

Next, an operation will be described.

First, an operation will be described in a case where an electromagnetic wave is radiated from an antenna element arranged on the opening side 11*a* of the hollow waveguide 11 in each of the waveguide strip line transducers 31*a*, 31*b*, 31*c*, and 31*d* (see FIGS. 6A and 6C).

An electromagnetic wave is incident from the opening 11*a* of the hollow waveguide 11 in the waveguide strip line transducer 32 (See FIG. 6A).

The electromagnetic wave incident from the opening 11*a* of the hollow waveguide 11 in the waveguide strip line transducer 32 is propagated through the tube interior 11*b* of the hollow waveguide 11, and is incident from the tip 19*a* of the probe 19 in the waveguide strip line transducer 32.

The electromagnetic wave incident from the tip 19*a* of the probe 19 in the waveguide strip line transducer 32 is distributed as four electromagnetic waves by the synthesizing and distributing circuit 33 (See FIG. 6A).

The four electromagnetic waves distributed by the synthesizing and distributing circuit 33 are incident from one ends of the strip lines 2 in the waveguide strip line transducers 31*a*, 31*b*, 31*c*, and 31*d*, respectively.

The electromagnetic waves incident from one ends of the strip lines 2 in the waveguide strip line transducers 31*a*, 31*b*, 31*c*, and 31*d* are radiated from the tips 19*a* of the probes 19 in the waveguide strip line transducers 31*a*, 31*b*, 31*c*, and 31*d*, respectively.

The electromagnetic waves radiated from the tips 19*a* of the probes 19 in the waveguide strip line transducers 31*a*, 31*b*, 31*c*, and 31*d* are divided into an electromagnetic wave traveling toward the opening side 11*a* of the hollow waveguide 11 in a corresponding one of the waveguide strip line transducers 31*a*, 31*b*, 31*c*, and 31*d*, and an electromagnetic wave traveling toward the back short 17*a* in a corresponding one of the waveguide strip line transducers 31*a*, 31*b*, 31*c*, and 31*d*.

The electromagnetic wave traveling toward the back short 17*a* is reflected by the back short 17*a* and then travels toward the opening side 11*a* of the hollow waveguide 11.

In the second embodiment, the tip 19*a* of the probe 19 in each of the waveguide strip line transducers 31*a*, 31*b*, 31*c*, and 31*d* is arranged at a position where the distance between the center of the tip 19*a* of the probe 19 and the back short 17*a* is about λg/4, similarly to the waveguide strip line transducer of FIG. 1A. Consequently, a phase of the electromagnetic wave reflected by the back short 17*a* and traveling toward the opening side 11*a* of the hollow waveguide 11 and a phase of the electromagnetic wave radiated from the tip 19*a* of the probe 19 and directly traveling toward the opening side 11*a* of the hollow waveguide 11 are in-phase.

As a result, both electromagnetic waves interfere with and intensify each other, so that a large power electromagnetic wave can be supplied to the antenna element.

Next, an operation will be described in a case where an electromagnetic wave is received from the antenna element arranged on the opening side 11*a* of the hollow waveguide 11 in each of the waveguide strip line transducers 31*a*, 31*b*, 31*c*, and 31*d*.

An electromagnetic wave output from the antenna element is incident from the opening 11*a* of the hollow waveguide 11 in each of the waveguide strip line transducers 31*a*, 31*b*, 31*c*, and 31*d*.

The electromagnetic wave incident from the opening 11*a* of the hollow waveguide 11 in each of the waveguide strip line transducers 31*a*, 31*b*, 31*c*, and 31*d* is propagated through the tube interiors 11*b* of the hollow waveguides 11, and are incident from the tip 19*a* of the probe 19 in each of the waveguide strip line transducers 31*a*, 31*b*, 31*c*, and 31*d*.

The electromagnetic waves incident from the tips 19*a* of the probes 19 in the waveguide strip line transducers 31*a*, 31*b*, 31*c*, and 31*d*, respectively, are synthesized by the synthesizing and distributing circuit 33.

The electromagnetic wave synthesized by the synthesizing and distributing circuit 33 is incident from one end of the strip line 2 in the waveguide strip line transducer 32.

The electromagnetic wave incident from one end of the strip line 2 in the waveguide strip line transducer 32 is radiated from the tip 19*a* of the probe 19 in the waveguide strip line transducer 32.

The electromagnetic wave radiated from the tip 19*a* of the probe 19 in the waveguide strip line transducer 32 is divided into an electromagnetic wave traveling toward the opening side 11*a* of the hollow waveguide 11 in the waveguide strip line transducer 32, and an electromagnetic wave traveling toward the back short 17*a* in the waveguide strip line transducer 32.

The electromagnetic wave traveling toward the back short 17*a* is reflected by the back short 17*a* and then travels toward the opening side 11*a* of the hollow waveguide 1.

In the second embodiment, the tip 19*a* of the probe 19 in the waveguide strip line transducer 32 is arranged at a position where the distance between the center of the tip 19*a* of the probe 19 and the back short 17*a* is about λg/4, similarly to the waveguide strip line transducer of FIGS. 1A, 1B and 1C. Consequently, the phase of the electromagnetic wave reflected by the back short 17*a* and traveling toward the opening side 11*a* of the hollow waveguide 11 and the phase of the electromagnetic wave radiated from the tip 19*a* of the probe 19 and directly traveling toward the opening side 11*a* of the hollow waveguide 11 are in-phase.

As a result, both electromagnetic waves interfere with and intensify each other, so that a large power electromagnetic wave can be output to an external circuit, which is not illustrated.

Each of the waveguide strip line transducers 31*a*, 31*b*, 31*c*, and 31*d* and the waveguide strip line transducer 32 mounted on the power feed circuit in FIG. 5 is the same waveguide strip line transducer as that shown in FIGS. 1A, 1B and 1C having a smaller external dimension than the waveguide strip line transducer in which the substrate is provided on the upper side of one tube wall.

Thus, the external dimension of the power feed circuit can be made smaller than that in a case where a waveguide strip line transducer, in which the substrate is provided on the upper side of one tube wall, is mounted. That is, the dimension in the z direction of the power feed circuit can be shortened.

In a case where a plurality of the antenna elements forming an array antenna is arranged in a two-dimensional plane, that is, in a case where the plurality of antenna elements is arranged in the x-z plane, it is necessary to array a plurality of the power feed circuits of FIG. 5 in the z direction; however, since the dimension in the z direction of the power feed circuit can be shortened, the footprint of the array antenna can be made smaller than in the case where the waveguide strip line transducer, in which the substrate is provided on the upper side of one tube wall, is mounted.

In the second embodiment, the first transducer group 31 including the waveguide strip line transducers 31*a*, 31*b*, 31*c*, and 31*d* and the waveguide strip line transducer 32 can be arranged to be in contact with each other.

Thus, the dimension in the y direction that is the tube axis direction can also be shortened.

In the second embodiment, the substrate 1 including the strip line 2 wired in its inner layer is shared by the waveguide strip line transducers 31*a*. 31*b*, 31*c*, and 31*d* and the waveguide strip line transducer 32, and the synthesizing and distributing circuit 33 is formed in the inner layer of the substrate 1. Therefore, it is unnecessary to additionally prepare a substrate for mounting the synthesizing and distributing circuit 33, so that the increase of the number of parts required for forming the synthesizing and distributing circuit 33 can be suppressed.

In the second embodiment, the first transducer group 31 and the waveguide strip line transducer 32 that is the second transducer are connected together by the synthesizing and distributing circuit 33. In addition, a third transducer, a fourth transducer, or the like may be connected together by a synthesizing and distributing circuit.

In the second embodiment, an example has been described in which each of the waveguide strip line transducers 31*a*, 31*b*, 31*c*, and 31*d* and the waveguide strip line transducer 32 is the same as the waveguide strip line transducer shown in FIGS. 1A, 18B and IC; however, each of the waveguide strip line transducers 31*a*, 31*b*, 31*c*, and 31*d* and the waveguide strip line transducer 32 may be the same as the waveguide strip line transducer shown in FIG. 4.

Figure 7:
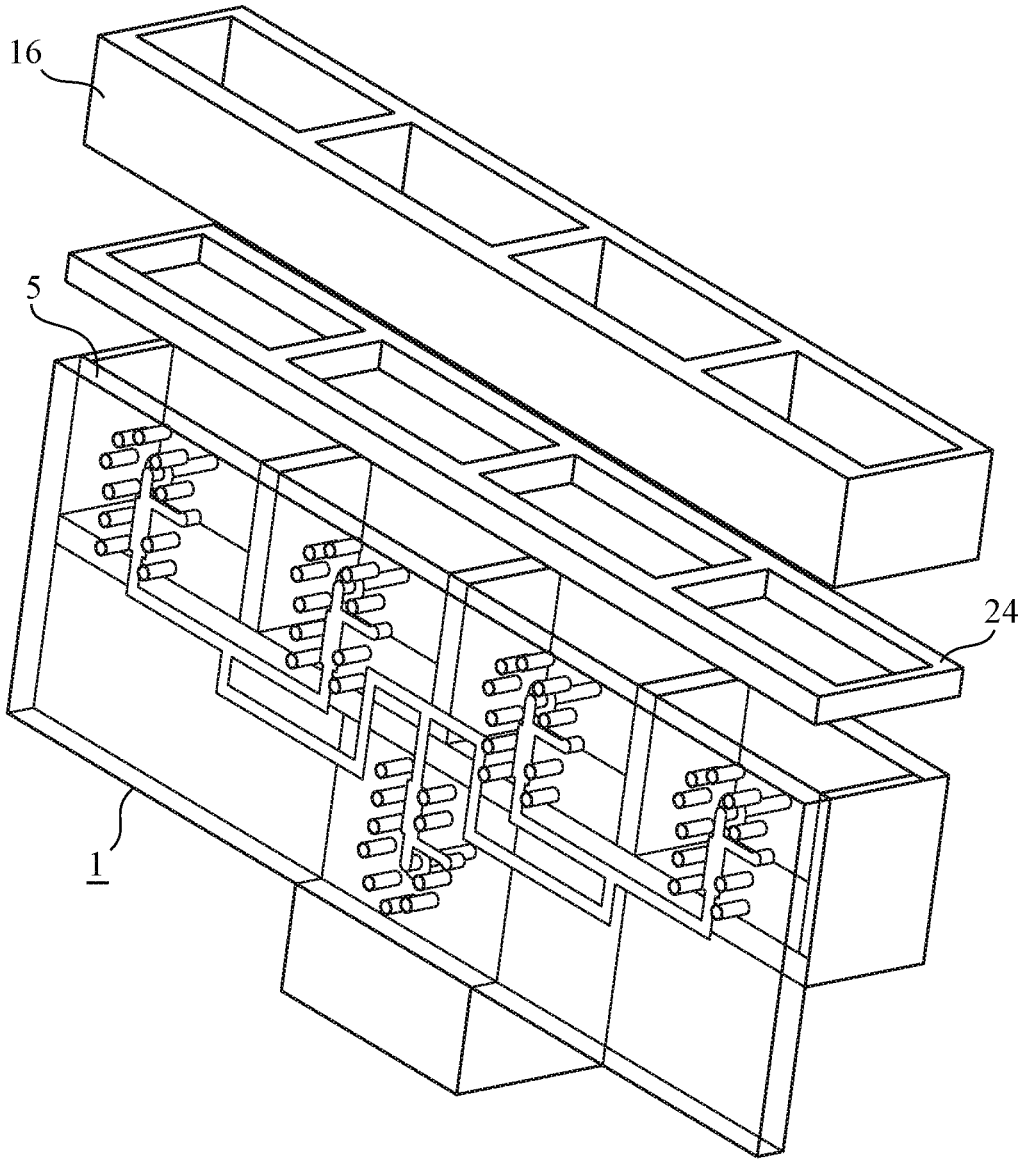
FIG. 7 is an exploded view illustrating another power feed circuit according to the second embodiment of the present invention.

FIG. 7 is an exploded view illustrating another power feed circuit according to the second embodiment of the present invention.

In the example of FIG. 7, a conductor plate 24 is provided similarly to the waveguide strip line transducer of FIG. 4.

Third Embodiment

In the second embodiment, a power feed circuit including the waveguide strip line transducers 31*a*, 31*b*, 31*c*, and 31*d* arranged in the x direction (FIG. 5) and one waveguide strip line transducer 32 is described.

In a third embodiment, a power feed circuit including sets of waveguide strip line transducers which are arranged in the z direction will be described. Each of the sets (hereinafter referred to as the "waveguide strip line transducer group") includes the waveguide strip line transducers 31*a*, 31*b*, 31*c*, and 31*d* arranged in the x direction and one waveguide strip line transducer 32.

That is, a power feed circuit will be described below in which M waveguide strip line transducer groups are arranged in the z direction, and the first transducer group 31 in each of the M waveguide strip line transducer groups includes N waveguide strip line transducers, where M is an integer of 2 or more, and N is an integer of 2 or more.

Figure 8:
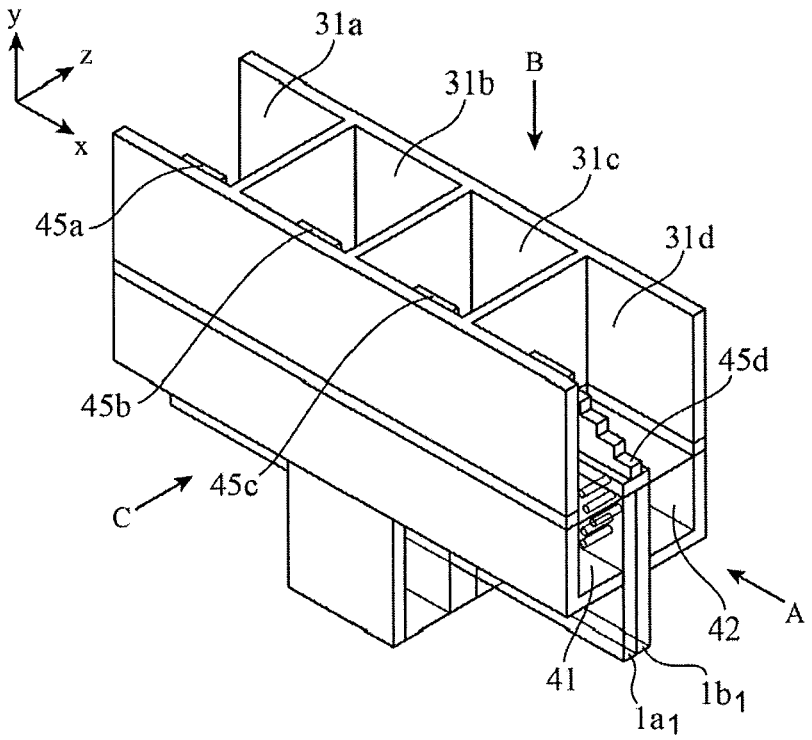
FIG. 8 is a transparent perspective view illustrating a power feed circuit according to a third embodiment of the present invention.

FIG. 8 is a transparent perspective view illustrating a power feed circuit according to the third embodiment of the present invention.

Figure 9A:
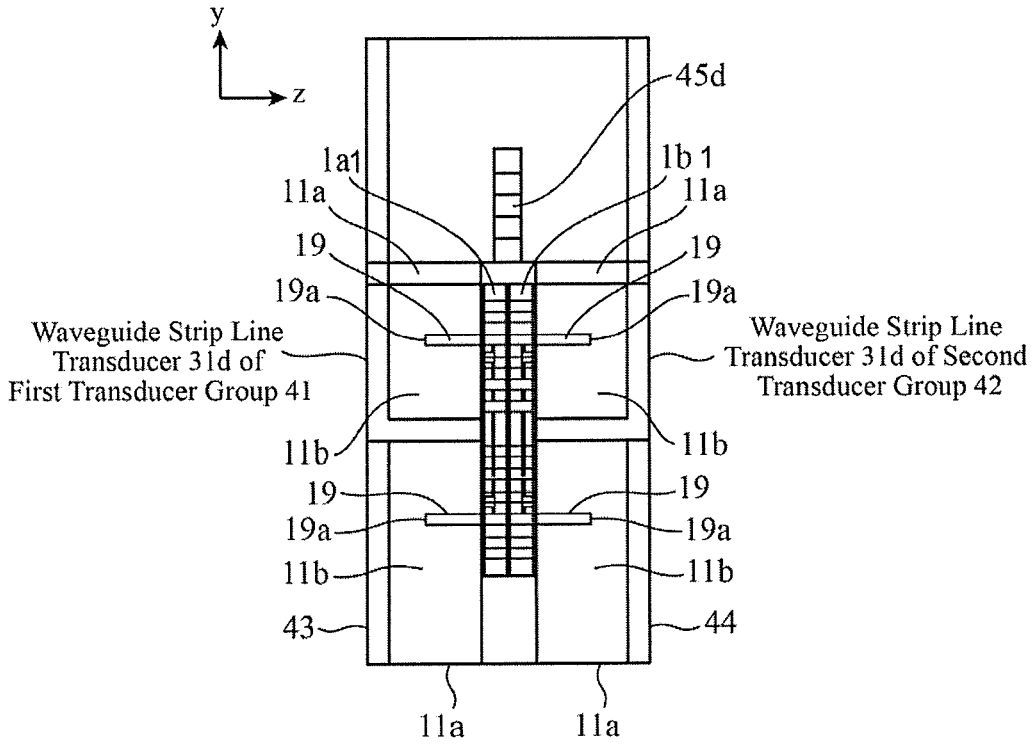
FIG. 9A is a transparent view illustrating the power feed circuit as viewed from direction A in FIG. 8.
Figure 9B:
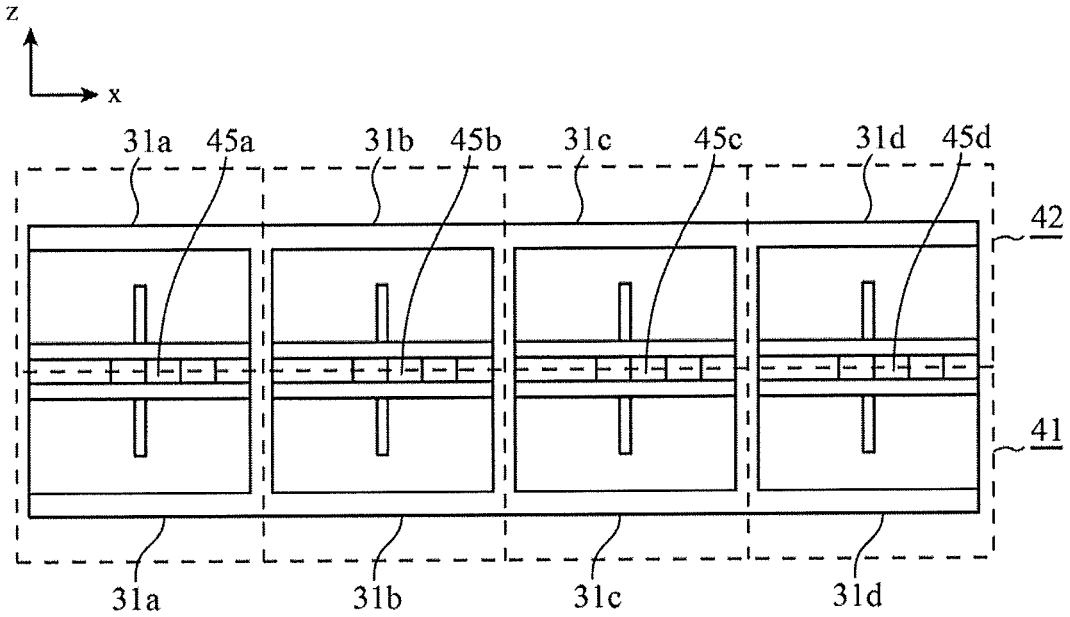
FIG. 9B is a transparent view illustrating the power feed circuit as viewed from direction B in FIG. 8.

FIGS. 9A and 9B is a transparent view illustrating the power feed circuit according to the third embodiment of the present invention.

FIG. 9A is a transparent view illustrating the power feed circuit as viewed from direction A in FIG. 8, and FIG. 9B is a transparent view illustrating the power feed circuit as viewed from direction B in FIG. 8.

In FIGS. 8 and 9A and 9B, since the same reference numerals as those in FIGS. 1, 5, and 6A-6C denote the same or corresponding portions, the description thereof will be omitted.

In FIGS. 8 and 9A and 9B, for convenience of drawing of substrates 1*a*1 and 1*b*1 (FIGS. 8 and 9B), a septum 45*d*, and the like, tube walls at both ends of the hollow waveguide 11 (shown in FIG. 1A) in the x direction (FIGS. 8 and 9A) are omitted; however, actually, the tube walls exist at both ends of the hollow waveguide 11 in the x direction.

In FIG. 8, for simplicity of explanation, an example in which M=2 and N=4 is illustrated.

That is, two waveguide strip line transducer groups are arranged in the z direction, and the first transducer group 41 in each of the two waveguide strip line transducer groups includes four waveguide strip line transducers.

Similarly to the first transducer group 31 shown in FIG. 5, a first transducer group 41 includes the waveguide strip line transducers 31*a*, 31*b*, 31*c*, and 31*d*.

In FIG. 8, the common substrate 1 (see FIG. 1A) shared by the waveguide strip line transducers 31*a*, 31*b*, 31*c*, and 31*d* included in the first transducer group 41 is denoted by a reference numeral 1*a* for convenience of explanation.

Similarly to the first transducer group 31 shown in FIG. 5, a first transducer group 42 includes the waveguide strip line transducers 31*a*, 31*b*, 31*c*, and 31*d*.

In FIG. 8, the common substrate 1 (see FIG. 1A) shared by the waveguide strip line transducers 31*a*, 31*b*, 31*c*, and 31*d* included in the first transducer group 42 is denoted by a reference numeral 1*b* for convenience of explanation.

The substrate 1*a*1 and the substrate 1*b*1 may be separate substrates, but may be different layers in the common substrate 1.

The waveguide strip line transducer 31*a* included in the first transducer group 41 and the waveguide strip line transducer 31*a* included in the first transducer group 42 are arranged such that the substrate 1*a*1 and the substrate 1*b*1 face each other.

The waveguide strip line transducer 31*b* included in the first transducer group 41 and the waveguide strip line transducer 31*b* included in the first transducer group 42 are arranged such that the substrate 1*a*1 and the substrate 1*b*1 face each other.

The waveguide strip line transducer 31*c* included in the first transducer group 41 and the waveguide strip line transducer 31*c* included in the first transducer group 42 are arranged such that the substrate 1*a*1 and the substrate 1*b*1 face each other.

The waveguide strip line transducer 31*d* included in the first transducer group 41 and the waveguide strip line transducer 31*d* included in the first transducer group 42 are arranged such that the substrate 1*a*1 and the substrate 1*b*1 face each other.

A waveguide strip line transducer 43 (FIG. 9A) that is the second transducer is the same as the waveguide strip line transducer shown in FIGS. 1A, 1B and 1C, and is connected to the waveguide strip line transducers 31*a*, 31*b*, 31*c*, and 31*d* included in the first transducer group 41 via the synthesizing and distributing circuit 33.

A waveguide strip line transducer 44 (FIG. 9A) that is the second transducer is the same as the waveguide strip line transducer shown in FIGS. 1A, 1B and 1C, and is connected to the waveguide strip line transducers 31*a*, 31*b*, 31*c*, and 31*d* included in the first transducer group 42 via the synthesizing and distributing circuit 33.

In the third embodiment, for convenience of explanation, an electromagnetic wave input/output by each of the waveguide strip line transducers 31*a*, 31*b*, 31*c*, and 31*d* included in the first transducer group 41 is assumed to be a polarized wave A2, an electromagnetic wave input/output by each of the waveguide strip line transducers 31*a*, 31*b*, 31*c*, and 31*d* included in the first transducer group 42 is assumed to be a polarized wave B2, and it is assumed that the polarized waves A2 and B2 are different in polarization.

For example, a combination in which the polarized wave A2 has a right-handed polarization and the polarized wave B2 has a left-handed polarization can be considered.

A septum 45*a* (FIGS. 8 and 9B) is a circularly polarized wave generator to which the waveguide strip line transducer 31*a* included in the first transducer group 41 and the waveguide strip line transducer 31*a* included in the first transducer group 42 are connected.

For example, the septum 45*a* (FIGS. 8 and 9B) synthesizes the polarized wave A2 radiated from the probe 19 of the waveguide strip line transducer 31*a* included in the first transducer group 41 and the polarized wave B2 radiated from the probe 19 of the waveguide strip line transducer 31*a* included in the first transducer group 42, and outputs a circularly polarized wave toward an antenna element.

A septum 45*b* (FIGS. 8 and 9B) is a circularly polarized wave generator to which the waveguide strip line transducer 31*b* included in the first transducer group 41 and the waveguide strip line transducer 31*b* included in the first transducer group 42 are connected.

For example, the septum 45*b* synthesizes the polarized wave A2 radiated from the probe 19 of the waveguide strip line transducer 31*b* included in the first transducer group 41 and the polarized wave B2 radiated from the probe 19 of the waveguide strip line transducer 31*b* included in the first transducer group 42, and outputs a circularly polarized wave toward the antenna element.

A septum 45*c* (FIGS. 8 and 9B) is a circularly polarized wave generator to which the waveguide strip line transducer 31*c* included in the first transducer group 41 and the waveguide strip line transducer 31*c* included in the first transducer group 42 are connected.

For example, the septum 45*c* synthesizes the polarized wave A2 radiated from the probe 19 of the waveguide strip line transducer 31*c* included in the first transducer group 41 and the polarized wave B2 radiated from the probe 19 of the waveguide strip line transducer 31*c* included in the first transducer group 42, and outputs a circularly polarized wave toward the antenna element.

A septum 45*d* (FIGS. 8 and 9B) is a circularly polarized wave generator to which the waveguide strip line transducer 31*d* included in the first transducer group 41 and the waveguide strip line transducer 31*d* included in the first transducer group 42 are connected.

For example, the septum 45*d* (FIGS. 8 and 9B) synthesizes the polarized wave A2 radiated from the probe 19 of the waveguide strip line transducer 31*d* included in the first transducer group 41 and the polarized wave B2 radiated from the probe 19 of the waveguide strip line transducer 31*d* included in the first transducer group 42, and outputs a circularly polarized wave toward the antenna element.

Here, an example is described in which two waveguide strip line transducer groups are arranged in the z direction, and the first transducer group in each of the two waveguide strip line transducer groups includes four waveguide strip line transducers.

Thus, for example, the waveguide strip line transducer 31*a* included in the first transducer group 41 and the waveguide strip line transducer 31*a* included in the first transducer group 42 are connected to the same septum 45*a*.

In a case where the M waveguide strip line transducer groups are arranged in the z direction and the first transducer group in each of the M waveguide strip line transducer groups includes N waveguide strip line transducers, among the M waveguide strip line transducer groups, an n-th row waveguide strip line transducer included in the first transducer group in an m-th column waveguide strip line transducer group and an n-th row waveguide strip line transducer included in the first transducer group in an (m+1)-th column waveguide strip line transducer group are connected to the same septum.

Further, the synthesizing and distributing circuit 33 connected to the strip lines 2 of the N waveguide strip line transducers included in the first transducer group in the m-th column waveguide strip line transducer group is formed in an inner layer of the substrate 1*a*1, and the synthesizing and distributing circuit 33 connected to the strip lines 2 of the N waveguide strip line transducers included in the first transducer group in the (m+1)-th column waveguide strip line transducer group is formed in the inner layer of the substrate 1*b*1.

As described before, the substrate 1*a*1 and the substrate 1*b*1 may be separate substrates, but may be different layers in the common substrate 1.

FIGS. 10A, 10B, 10C and 10D are a transparent view illustrating the substrates 1*a*1 and 1*b*1 of the power feed circuit according to the third embodiment of the present invention.

Figure 10A:
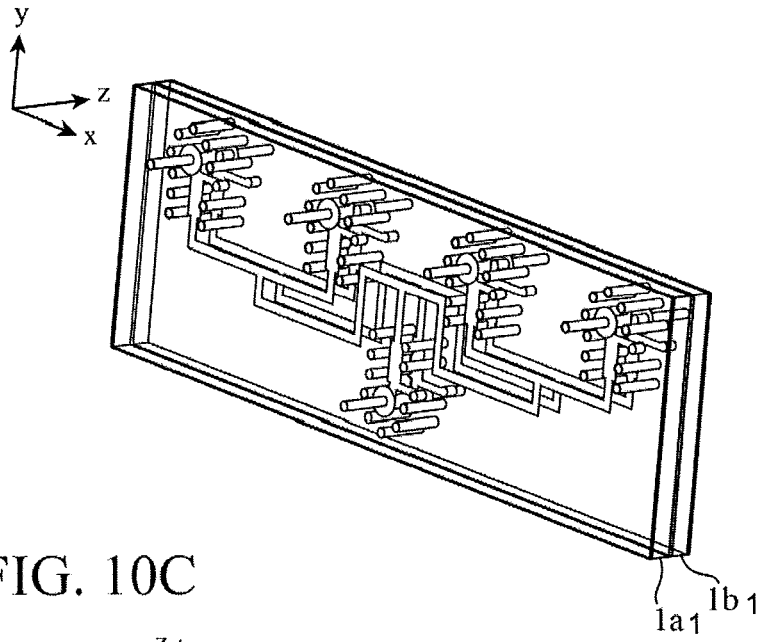
FIG. 10A is a transparent perspective view illustrating substrates 1*a*1 and 1*b*1 of the power feed circuit of FIG. 8.
Figure 10B:
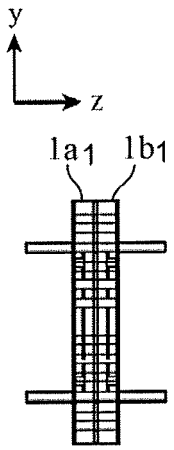
FIG. 10B is a transparent view illustrating the substrates 1*a*1 and 1*b*1 of the power feed circuit as viewed from direction A in FIG. 8.

FIG. 10A is a transparent perspective view illustrating the substrates 1*a*1 and 1*b*1 of the power feed circuit of FIG. 8, and FIG. 10B is a transparent view illustrating the substrates 1*a*1 and 1*b*1 of the power feed circuit as viewed from direction A in FIG. 8.

Figure 10C:
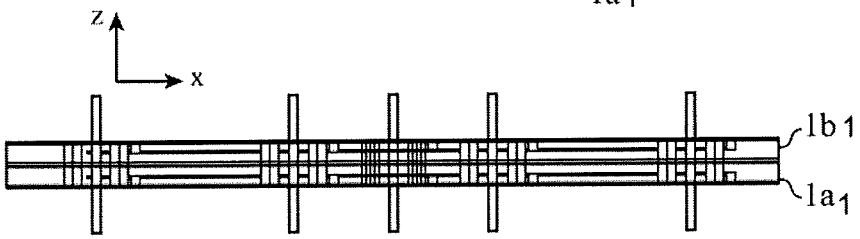
FIG. 10C is a transparent view illustrating the substrates 1*a*1 and 1*b*1 of the power feed circuit as viewed from direction B in FIG. 8.
Figure 10D:
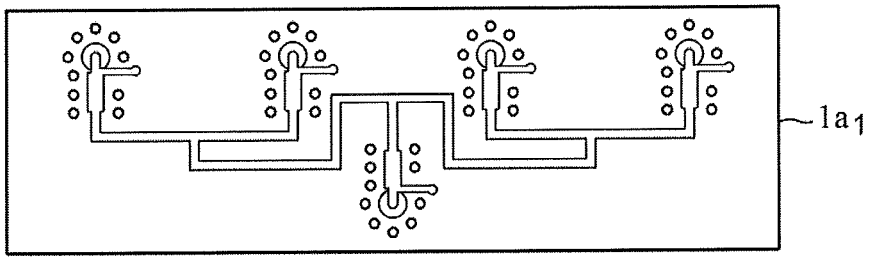
FIG. 10D is a transparent view illustrating the substrate 1*a*1 of the power feed circuit as viewed from direction C in FIG. 8.

FIG. 10C is a transparent view illustrating the substrates 1*a*1 and 1*b*1 of the power feed circuit as viewed from direction B in FIG. 8, and FIG. 10D is a transparent view illustrating the substrate 1*a* of the power feed circuit as viewed from direction C in FIG. 8.

Next, an operation will be described.

First, the operation will be described in a case where a circularly polarized wave is radiated from the antenna element arranged on the opening side 11*a* of the hollow waveguide 11 in each of the waveguide strip line transducers 31*a*, 31*b*, 31*c*, and 31*d* included in each of the first transducer groups 41 and 42.

A polarized wave A2 is incident from the opening 11*a* of the hollow waveguide 11 in the waveguide strip line transducer 43.

Further, a polarized wave B2 is incident from the opening 11*a* of the hollow waveguide 11 in the waveguide strip line transducer 44.

The polarized wave A2 incident from the opening 11*a* of the hollow waveguide 11 in the waveguide strip line transducer 43 is propagated through the tube interior 11*b* of the hollow waveguide 11, and is incident from the tip 19*a* of the probe 19 in the waveguide strip line transducer 43.

Further, the polarized wave B2 incident from the opening 11*a* of the hollow waveguide 11 in the waveguide strip line transducer 44 is propagated through the tube interior 11*b* of the hollow waveguide 11, and is incident from the tip 19*a* of the probe 19 in the waveguide strip line transducer 44.

The polarized wave A2 incident from the tip 19*a* of the probe 19 in the waveguide strip line transducer 43 is distributed as four polarized waves A2 by the synthesizing and distributing circuit 33.

The four polarized waves A2 distributed by the synthesizing and distributing circuit 33 are respectively incident from one ends of the strip lines 2 in the waveguide strip line transducers 31*a*, 31*b*, 31*c*, and 31*d* included in the first transducer group 41.

Further, the polarized wave B2 incident from the tip 19*a* of the probe 19 in the waveguide strip line transducer 44 is distributed as four polarized waves B2 by the synthesizing and distributing circuit 33.

The four polarized waves B2 distributed by the synthesizing and distributing circuit 33 are respectively incident from one ends of the strip lines 2 in the waveguide strip line transducers 31*a*, 31*b*, 31*c*, and 31*d* included in the first transducer group 42.

The polarized waves A2 incident from one ends of the strip lines 2 in the waveguide strip line transducers 31*a*, 31*b*, 31 *c*, and 31*d* included in the first transducer group 41 are radiated from the tips 19*a* of the probes 19 in the waveguide strip line transducer 31*a*. 31*b*, 31*c*, and 31*d*, respectively.

Each of the polarized waves A2 radiated from the tips 19*a* of the probes 19 in the waveguide strip line transducers 31*a*, 31*b*, 31*c*, and 31*d* included in the first transducer group 41 is divided into a polarized wave A2 traveling toward the opening side 11*a* of the hollow waveguide 11 in a corresponding one of the waveguide strip line transducers 31*a*, 31*b*, 31*c*, and 31*d*, and a polarized wave A2 traveling toward the back short 17*a*.

The polarized wave A2 traveling toward the back short 17*a* is reflected by the back short 17*a* and then travels toward the opening side 11*a* of the hollow waveguide 11.

A phase of the polarized wave A2 reflected by the back short 17*a* and traveling toward the opening side 11*a* of the hollow waveguide 11 and a phase of the polarized wave A2 radiated from the tip 19*a* of the probe 19 and directly traveling toward the opening side 11*a* of the hollow waveguide 11 are in-phase.

As a result, both polarized waves A2 interfere with and intensify each other, so that a large power polarized wave A2 can be output from the opening 11*a* of the hollow waveguide 11.

In addition, the polarized waves B2 incident from one ends of the strip lines 2 in the waveguide strip line transducers 31*a*, 31*b*, 31*c*, and 31*d* included in the first transducer group 42 are radiated from the tips 19*a* of the probes 19 in the waveguide strip line transducer 31*a*, 31*b*, 31*c*, and 31*d*, respectively.

Each of the polarized waves B2 radiated from the tips 19*a* of the probes 19 in the waveguide strip line transducers 31*a*, 31*b*, 31*c*, and 31*d* included in the first transducer group 42 is divided into a polarized wave B2 traveling toward the opening side 11*a* of the hollow waveguide 11 in a corresponding one of the waveguide strip line transducers 31*a*, 31*b*, 31*c*, and 31*d*, and a polarized wave B2 traveling toward the back short 17*a*.

The polarized wave B2 traveling toward the back short 17*a* is reflected by the back short 17*a* and then travels toward the opening side 11*a* of the hollow waveguide 11.

A phase of the polarized wave B2 reflected by the back short 17*a* and traveling toward the opening side 11*a* of the hollow waveguide 11 and a phase of the polarized wave B2 radiated from the tip 19*a* of the probe 19 and directly traveling toward the opening side 11*a* of the hollow waveguide 11 are in-phase.

As a result, both polarized waves B2 interfere with and intensify each other, so that a large power polarized wave B2 can be output from the opening 11*a* of the hollow waveguide 11.

The septum 45*a* synthesizes the polarized wave A2 output from the opening 11*a* of the hollow waveguide 11 in the waveguide strip line transducer 31*a* included in the first transducer group 41 and the polarized wave B2 output from the opening 11*a* of the hollow waveguide 11 in the waveguide strip line transducer 31*a* included in the first transducer group 42, and outputs the circularly polarized wave toward the antenna element.

The septum 45*b* synthesizes the polarized wave A2 output from the opening 11*a* of the hollow waveguide 11 in the waveguide strip line transducer 31*b* included in the first transducer group 41 and the polarized wave B2 output from the opening 11*a* of the hollow waveguide 11 in the waveguide strip line transducer 31*b* included in the first transducer group 42, and outputs the circularly polarized wave toward the antenna element.

The septum 45*c* synthesizes the polarized wave A2 output from the opening 11*a* of the hollow waveguide 11 in the waveguide strip line transducer 31*c* included in the first transducer group 41 and the polarized wave B2 output from the opening 11*a* of the hollow waveguide 11 in the waveguide strip line transducer 31*c* included in the first transducer group 42, and outputs the circularly polarized wave toward the antenna element.

The septum 45*d* synthesizes the polarized wave A2 output from the opening 11*a* of the hollow waveguide 11 in the waveguide strip line transducer 31*d* included in the first transducer group 41 and the polarized wave B2 output from the opening 11*a* of the hollow waveguide 11 in the waveguide strip line transducer 31*d* included in the first transducer group 42, and outputs the circularly polarized wave toward the antenna element.

Next, the operation will be described in a case where a circularly polarized wave is received from the antenna element arranged on the opening side 11*a* of the hollow waveguide 11 in each of the waveguide strip line transducers 31*a*, 31*b*, 31*c*, and 31*d* included in each of the first transducer groups 41 and 42.

The circularly polarized wave received by the antenna element is incident on the septa 45*a*, 45*b*, 45*c*, and 45*d*.

The septum 45*a* distributes the incident circularly polarized wave A2 the polarized wave A2 and the polarized wave B2, and outputs the polarized wave A2 to the waveguide strip line transducer 31*a* included in the first transducer group 41, and outputs the polarized wave B2 to the waveguide strip line transducer 31*a* included in the first transducer group 42.

The septum 45*b* distributes the incident circularly polarized wave as the polarized wave A2 and the polarized wave B2, and outputs the polarized wave A2 to the waveguide strip line transducer 31*b* included in the first transducer group 41, and outputs the polarized wave B2 to the waveguide strip line transducer 31*b* included in the first transducer group 42.

The septum 45*c* distributes the incident circularly polarized wave A2 the polarized wave A2 and the polarized wave B2, and outputs the polarized wave A2 to the waveguide strip line transducer 31*c* included in the first transducer group 41, and outputs the polarized wave B2 to the waveguide strip line transducer 31*c* included in the first transducer group 42.

The septum 45*d* distributes the incident circularly polarized wave as the polarized wave A2 and the polarized wave B2, and outputs the polarized wave A2 to the waveguide strip line transducer 31*d* included in the first transducer group 41, and outputs the polarized wave B2 to the waveguide strip line transducer 31*d* included in the first transducer group 42.

The polarized waves A2 output from the septa 45*a*, 45*b*, 45*c*, and 45*d* are propagated through the tube interiors 11*b* of the hollow waveguides 11 in the waveguide strip line transducers 31*a*, 31*b*, 31*c*, and 31*d* included in the first transducer group 41, respectively, and are incident from the tips 19*a* of the probes 19 in the waveguide strip line transducers 31*a*, 31*b*, 31*c*, and 31*d*, respectively.

The polarized waves B2 output from the septa 45*a*, 45*b*, 45*c*, and 45*d* are propagated through the tube interiors 11*b* of the hollow waveguides 11 in the waveguide strip line transducers 31*a*, 31*b*, 31*c*, and 31*d* included in the first transducer group 42, respectively, and are incident from the tips 19*a* of the probes 19 in the waveguide strip line transducers 31*a*, 31*b*, 31*c*, and 31*d*, respectively.

The polarized waves A2 incident from the tips 19*a* of the probes 19 in the waveguide strip line transducers 31*a*, 31*b*, 31*c*, and 31*d* included in the first transducer group 41 are synthesized by the synthesizing and distributing circuit 33.

The polarized wave A2 synthesized by the synthesizing and distributing circuit 33 is incident from one end of the strip line 2 in the waveguide strip line transducer 43.

The polarized wave B2 incident from the tips 19*a* of the probes 19 in the waveguide strip line transducers 31*a*, 31*b*, 31*c*, and 31*d* included in the first transducer group 42 are synthesized by the synthesizing and distributing circuit 33.

The polarized wave B2 synthesized by the synthesizing and distributing circuit 33 is incident from one end of the strip line 2 in the waveguide strip line transducer 44.

The polarized wave A2 incident from one end of the strip line 2 in the waveguide strip line transducer 43 is radiated from the tip 19*a* of the probe 19 in the waveguide strip line transducer 43.

The polarized wave A2 radiated from the tip 19*a* of the probe 19 in the waveguide strip line transducer 43 is divided into a polarized wave A2 traveling toward the opening side 11*a* of the hollow waveguide 11 in the waveguide strip line transducer 43, and a polarized wave A2 traveling toward the back short 17*a* of the waveguide strip line transducer 43.

The polarized wave A2 traveling toward the back short 17*a* is reflected by the back short 17*a* and then travels toward the opening side 11*a* of the hollow waveguide 11.

The phase of the polarized wave A2 reflected by the back short 17*a* and traveling toward the opening side 11*a* of the hollow waveguide 11 and the phase of the polarized wave A2 radiated from the tip 19*a* of the probe 19 and directly traveling toward the opening side 11*a* of the hollow waveguide 11 are in-phase.

As a result, both polarized waves A2 interfere with and intensify each other, so that a large power polarized wave A2 can be output to an external circuit (not illustrated).

The polarized wave B2 incident from one end of the strip line 2 in the waveguide strip line transducer 44 is radiated from the tip 19*a* of the probe 19 in the waveguide strip line transducer 44.

The polarized wave B2 radiated from the tip 19*a* of the probe 19 in the waveguide strip line transducer 44 is divided into a polarized wave B2 traveling toward the opening side 11*a* of the hollow waveguide 11 in the waveguide strip line transducer 44, and a polarized wave B2 traveling toward the back short 17*a* of the waveguide strip line transducer 44.

The polarized wave B2 traveling toward the back short 17*a* is reflected by the back short 17*a* and then travels toward the opening side 11*a* of the hollow waveguide 11.

The phase of the polarized wave B2 reflected by the back short 17*a* and traveling toward the opening side 11*a* of the hollow waveguide 11 and the phase of the polarized wave B2 radiated from the tip 19*a* of the probe 19 and directly traveling toward the opening side 11*a* of the hollow waveguide 11 are in-phase.

As a result, both polarized waves B2 interfere with and intensify each other, so that a large power polarized wave B2 can be output to an external circuit (not illustrated).

According to the third embodiment, similarly to the case of the second embodiment, an effect can be obtained that the footprint of the array antenna can be made smaller than that in the case where the waveguide strip line transducer is mounted in which the substrate is provided on the upper side of one tube wall.

That is, each of the waveguide strip line transducers 31*a*, 31*b*, 31*c*, and 31*d* included in the first transducer groups 41 and 42, and each of the waveguide strip line transducers 43 and 44 that are the second transducers is the same as the waveguide strip line transducer shown in FIGS. 1A, 1B and 1C having a smaller external dimension than the waveguide strip line transducer in which the substrate is provided on the upper side of one tube wall.

Consequently, the dimension in the z axis direction of the power feed circuit can be shortened as compared with the case where the waveguide strip line transducer in which the substrate is provided on the upper side of one tube wall is mounted.

In a case where the plurality of antenna elements forming an array antenna is arranged in the x-z plane, it is necessary to array a plurality of the first transducer groups and the second transducers in the z direction; however, since the dimension in the z direction of the power feed circuit can be shortened, the footprint of the array antenna can be made smaller than that in the case where the waveguide strip line transducer, in which the substrate is provided on the upper side of one tube wall, is mounted.

In the third embodiment, in the first transducer group 41, the waveguide strip line transducer 43 and the first transducer group 31 including the waveguide strip line transducers 31*a*, 31*b*, 31*c*, and 31*d* can be arranged to be in contact with each other.

Further, in the first transducer group 42, the waveguide strip line transducer 44 and the first transducer group 31 including the waveguide strip line transducers 31*a*, 31*b*, 31*c*, and 31*d* can be arranged to be in contact with each other.

Consequently, the dimension in the y direction that is the tube axis direction can also be shortened.

In the third embodiment, the substrate 1*a*1 including the strip line 2 wired in the inner layer thereof is shared by the waveguide strip line transducers 31*a*, 31*b*, 31*c*, and 31*d* included in the first transducer group 41 and the waveguide strip line transducer 43, and the synthesizing and distributing circuit 33 is formed in the inner layer of the substrate 1*a*1.

Further, the substrate 1*b*1 including the strip line 2 wired in the inner layer is shared by the waveguide strip line transducers 31*a*, 31*b*, 31*c*, and 31*d* included in the first transducer group 42 and the waveguide strip line transducer 44, and the synthesizing and distributing circuit 33 is formed in the inner layer of the substrate 1b1.

Therefore, it is unnecessary to additionally prepare a substrate for mounting the synthesizing and distributing circuit 33, so that the increase of the number of parts for forming the synthesizing and distributing circuit 33 can be avoided.

In the third embodiment, among the M first transducer groups, the n-th row waveguide strip line transducer included in the m-th column first transducer group and the n-th row waveguide strip line transducer included in the (m+1)-th column first transducer group are connected to the same septum, so that the n-th row waveguide strip line transducer included in the m-th column first transducer group and the n-th row waveguide strip line transducer included in the (m+1)-th column first transducer group input and output different polarized waves, respectively, whereby the antenna element can transmit and receive a circularly polarized wave.

Fourth Embodiment

In a fourth embodiment, a power feed circuit will be described in which a transformer 47 is connected to a waveguide strip line transducer 46, and a circularly polarized wave generator input/output unit 48 is connected to the transformer 47.

Figure 11:
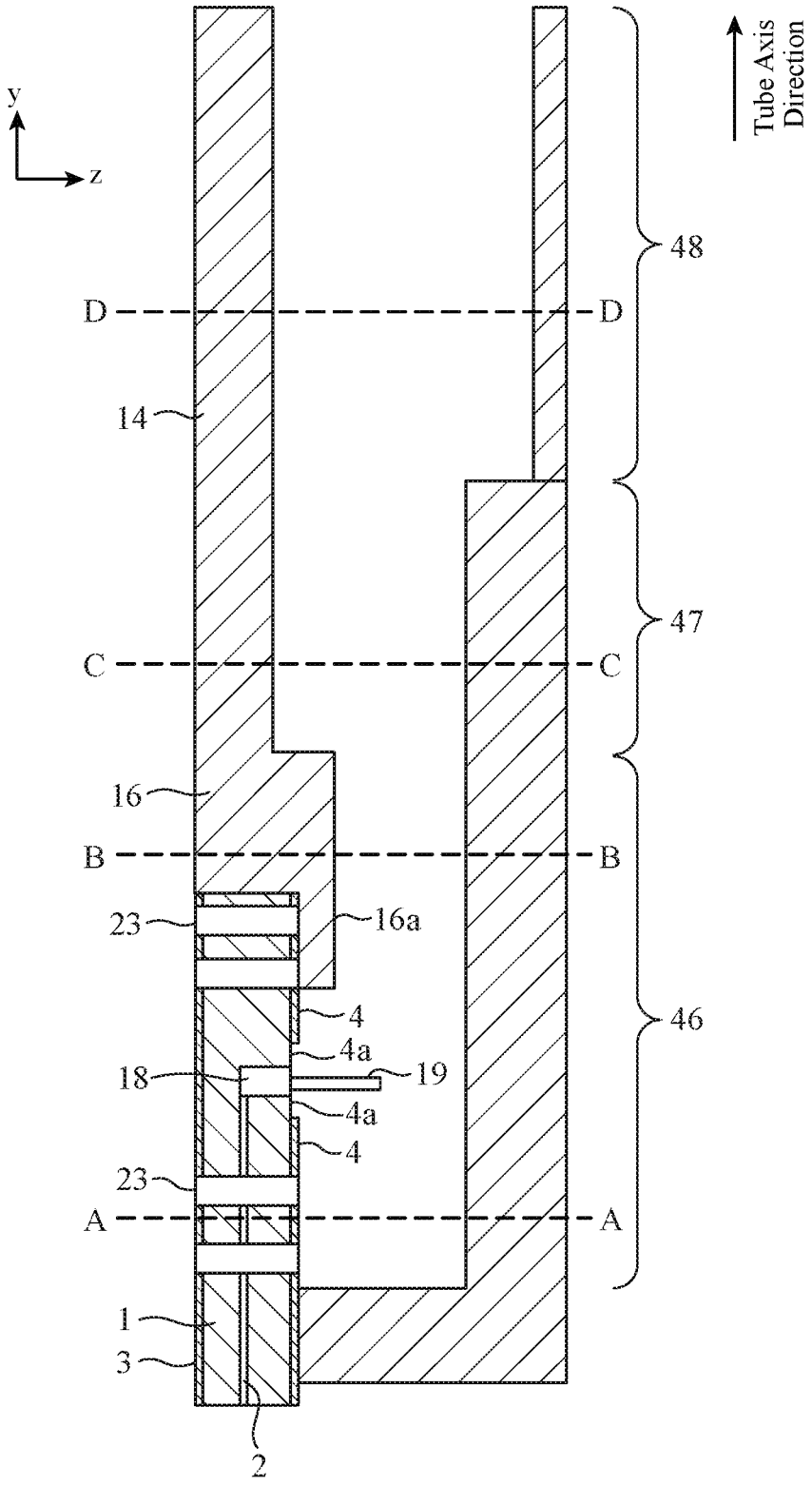
FIG. 11 is a cross-sectional view illustrating a power feed circuit according to a fourth embodiment of the present invention.

FIG. 11 is a cross-sectional view illustrating the power feed circuit according to the fourth embodiment of the present invention.

FIGS. 12A, 12B, 13A and 13B are cross-sectional views of main parts of the power feed circuit of FIG. 11.

Figure 12A:
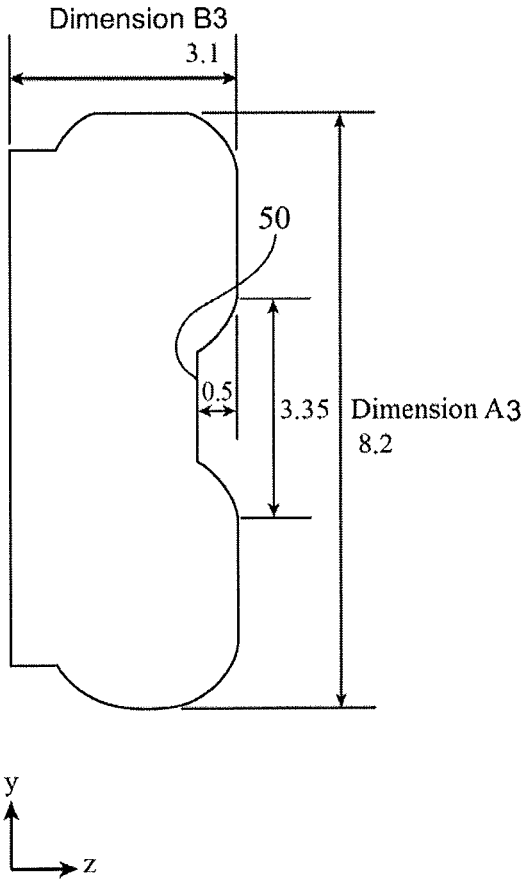
FIG. 12A is an A-A cross-sectional view in the power feed circuit of FIG. 11.
Figure 12B:
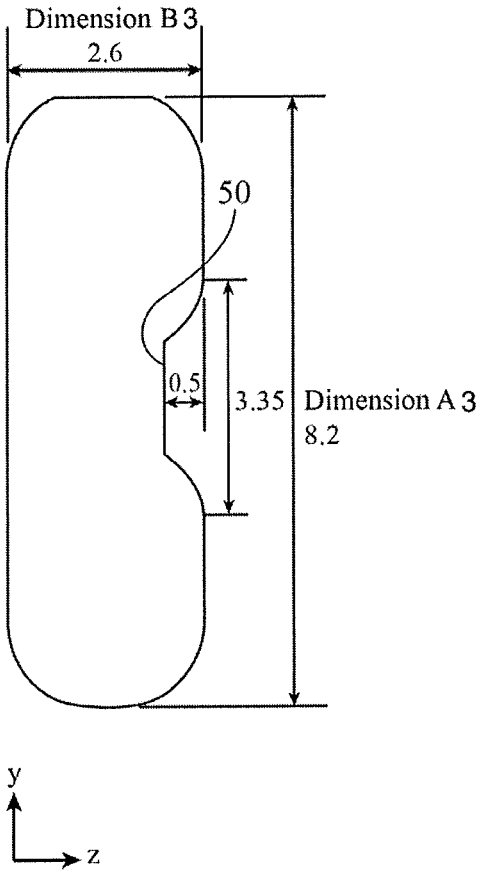
FIG. 12B is a B-B cross-sectional view in the power feed circuit of FIG. 11.

FIG. 12A is an A-A cross-sectional view in the power feed circuit of FIG. 11, and FIG. 12B is a B-B cross-sectional view in the power feed circuit of FIG. 1.

Figure 13B:
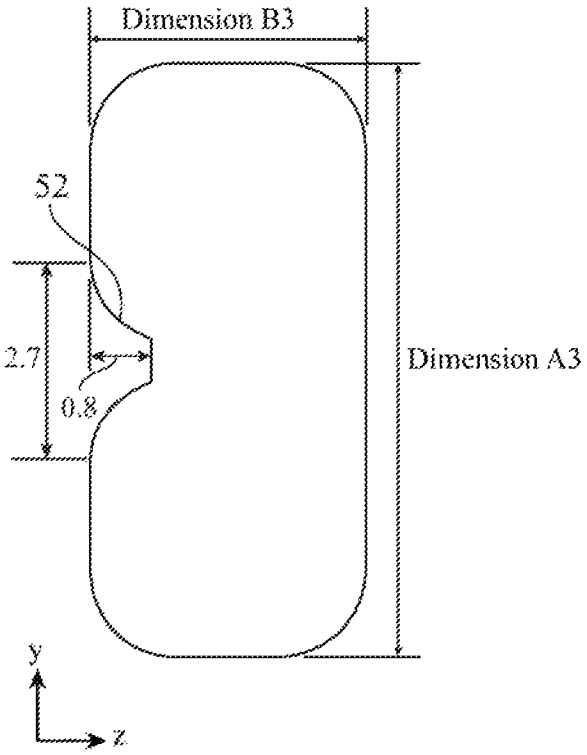
FIG. 13B is a D-D cross-sectional view in the power feed circuit of FIG. 11.
Figure 13A:
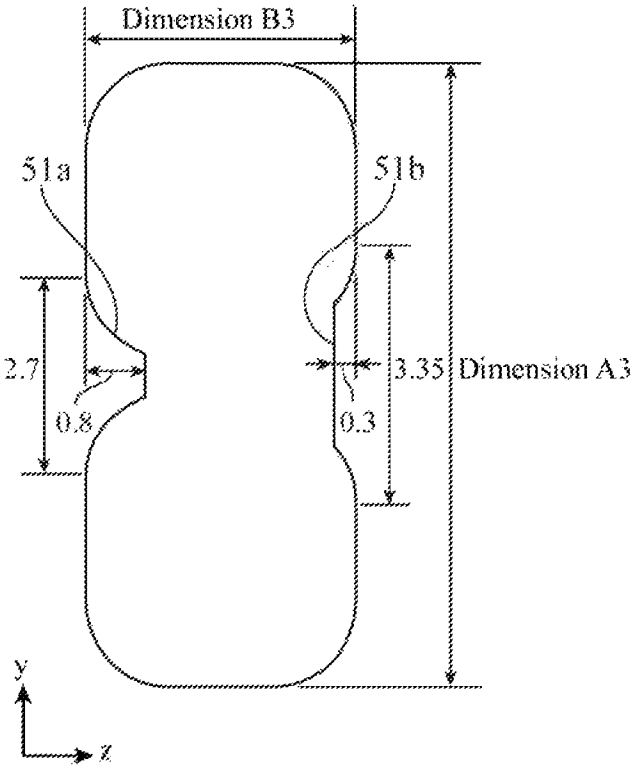
FIG. 13A is a C-C cross-sectional view in the power feed circuit of FIG. 11.

FIG. 13A is a C-C cross-sectional view in the power feed circuit of FIG. 11, and FIG. 13B is a D-D cross-sectional view in the power feed circuit of FIG. 11.

In FIGS. 11, 12A, 12B, 13A and 13B, since the same reference numerals as those in FIGS. 1A, 1B and 1C denote the same or corresponding portions, the description thereof will be omitted.

The waveguide strip line transducer 46 (see FIG. 11) corresponds to the waveguide strip line transducer shown in FIGS. 1A, 1B and IC.

The conductor 16 bonded to the end surface 5 (see FIG. 1a) on the opening side 11a (see FIG. 1a) of the hollow waveguide 11 (see FIG. 1a) of the waveguide strip line transducer 46 is connected to the second ground surface 4 (see FIGS. 1A and 1B) to cover a part of the second ground surface 4 (see FIGS. 1A and 1B) formed on the back surface of the substrate 1.

That is, the conductor 16 is bonded to the end surface 5 (see FIG. 1A) of the substrate 1 by, for example, a conductive bonding agent, a conductive screw, or the like, similarly to the first embodiment. In addition, a part of the conductor 16 is extended, and the extending portion 16a of the conductor 16 is bonded to the substrate 1 to cover the part of the second ground surface 4 (see FIGS. 1A and 1B).

As a result, the adhesion between the second ground surface 4 (see FIGS. 1A and 1B) and the conductor 16 is enhanced as compared with that in the first embodiment, and characteristics degradation factors, such as leakage of an electromagnetic wave due to incompleteness of the adhesion between the second ground surface 4 (see FIGS. 1A and 1B) and the conductor 16, can be suppressed.

The transformer 47 (See FIG. 11) is a member implemented by a hollow waveguide.

The transformer 47 has one end connected to one end of the hollow waveguide 11 of the waveguide strip line transducer 46 (See FIG. 11) and another end connected to one end of the circularly polarized wave generator input/output unit 48, and transforms a tube system between the waveguide strip line transducer 46 and the circularly polarized wave generator input/output unit 48 (See FIG. 11).

The circularly polarized wave generator input/output unit 48 is a member implemented by a hollow waveguide.

Figure 14:
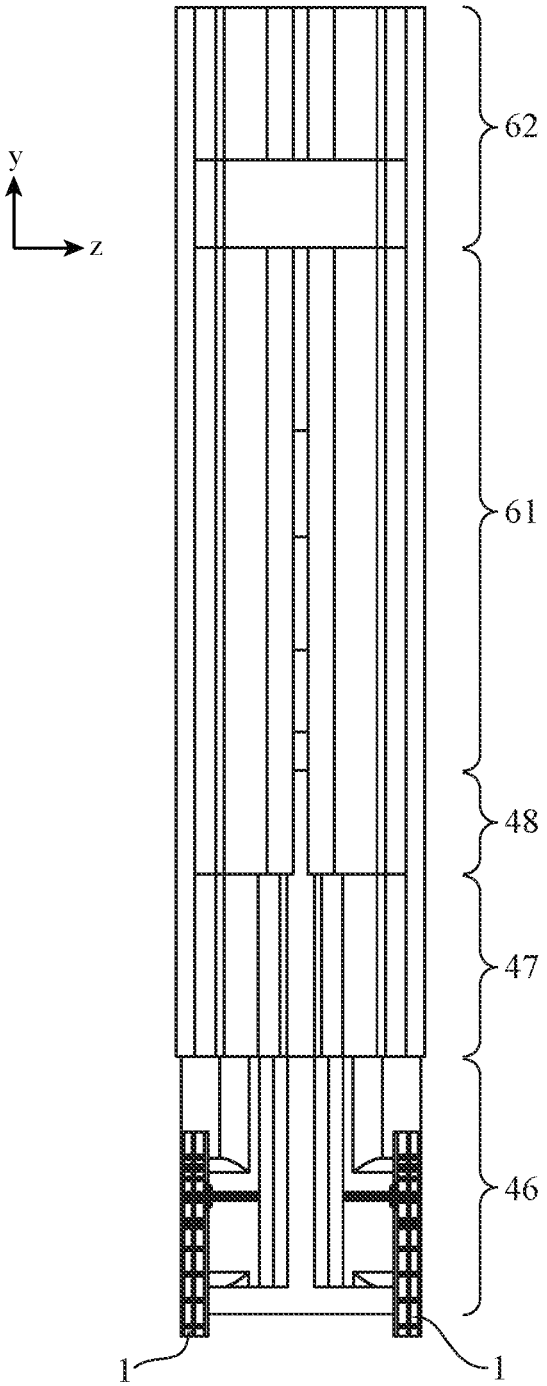
FIG. 14 is a cross-sectional view illustrating a power feed circuit according to a fifth embodiment of the present invention.

The circularly polarized wave generator input/output unit 48 has one end connected to the other end of the transformer 47 and another end connected to a circularly polarized wave generator 61 illustrated in FIG. 14.

In the fourth embodiment, a tube diameter of the hollow waveguide 11 in the waveguide strip line transducer 46 is smaller than a tube diameter of the transformer 47, and the tube diameter of the transformer 47 is smaller than a tube diameter of the circularly polarized wave generator input/output unit 48.

Here, the tube diameter of the hollow waveguide 11 in the waveguide strip line transducer 46 is a dimension B3 illustrated in each of FIGS. 12A and 12B, the tube diameter of the transformer 47 is a dimension B3 illustrated in FIG. 13A, and the tube diameter of the circularly polarized wave generator input/output unit 48 is a dimension B3 illustrated in FIG. 13B. The dimension B3 is the length in the z direction.

The dimension B3 illustrated in FIG. 12A is 3.1 (arbitrary units), the dimension B3 illustrated in FIG. 12B is 2.6 (arbitrary units), and the dimension B3 illustrated in FIG. 13A is 3.6 (arbitrary units), so that the tube diameter of the hollow waveguide 11 in the waveguide strip line transducer 46 is smaller than the tube diameter of the transformer 47.

Further, the dimension B3 illustrated in FIG. 13B is 3.85 (arbitrary units), so that the tube diameter of the transformer 47 is smaller than the tube diameter of the circularly polarized wave generator input/output unit 48.

In the fourth embodiment, as illustrated in FIGS. 12A and 12B, among the four tube walls 12, 13, 14, and 15 of the hollow waveguide 11 in the waveguide strip line transducer 46, a protrusion 50 is provided on an inner surface of the tube wall 14 (see FIG. 11) facing the tube wall 12 being the wall formed by the substrate 1.

In addition, as illustrated in FIG. 13A, among four tube walls of the transformer 47, a protrusion 51b is provided on an inner surface of a tube wall on the same side as the tube wall on which the protrusion 50 is provided, and a protrusion 51a is provided in FIGS. 12A and 12B on an inner surface of a tube wall facing the tube wall on the same side.

In addition, as illustrated in FIG. 13B, among four tube walls of the circularly polarized wave generator input/output unit 48, a protrusion 52 is provided on an inner surface of a tube wall on a side facing the tube wall on which the protrusion 50 is provided in FIGS. 12A and 12B.

FIGS. 12A and 12B also include arbitrary units 0.5, 3.35, 2.6, and 8.2, which are shown at various points in the drawings and denote the related dimension of certain sides. FIGS. 13A and 13B also include arbitrary units 0.3, 3.35, 2.7, 0.8 and 8.2, which are shown at various points in the drawings and denote the related dimension of certain sides. For example, Dimension A3 is designated as 8.2.

Effects of the fourth embodiment will be described.

The extending portion 16a of the conductor 16 is bonded to the substrate 1 to cover a part of the second ground surface 4 (see FIGS. 1A and 1B).

As a result, adhesion between the second ground surface 4 (see FIGS. 1A and 1B) and the conductor 16 is enhanced as compared with that in the first embodiment, and characteristic degradation factors, such as leakage of an electromagnetic wave due to incompleteness of the adhesion between the second ground surface 4 (see FIGS. 1A and 1B) and the conductor 16, can be suppressed.

In addition, since the conductor 16 includes the extending portion 16*a*, the dimension B3 of the hollow waveguide 11 in the waveguide strip line transducer 46 is narrower than the dimension B3 of the transformer 47 as illustrated in FIGS. 12B and 13A. As a result, by adjusting the length of the extending portion 16*a* in the z direction, the matching between the waveguide strip line transducer 46 and the circularly polarized wave generator input/output unit 48 can be achieved.

Therefore, the conductor 16 includes the extending portion 16*a*, whereby matching becomes easier than in a case where the matching between the waveguide strip line transducer 46 and the circularly polarized wave generator input/output unit 48 are performed only by the transformer 47.

In addition, in a case where the conductor 16 includes the extending portion 16*a*, the length in the y direction of the transformer 47 can be shortened in a case where the same degree of matching can be obtained as in the case where the matching is performed only by the transformer 47.

That is, in a case where the conductor 16 includes the extending portion 16*a*, matching becomes easier than in the case of matching only by the transformer 47, so that matching can be made even when the length of the transformer 47 in the y direction is short. Therefore, the length of the transformer 47 in the y direction can be shortened. As a result, the length can be shortened in the y direction of the power feed circuit, as compared with the case of matching only by the transformer 47.

As illustrated in FIGS. 12A and 12B, among the four tube walls 12, 13, 14, and 15 of the hollow waveguide 11 in the waveguide strip line transducer 46, the protrusion 50 is provided on the inner surface of the tube wall 14 facing the tube wall 12 being formed by the substrate 4, so that an effect that the band of the waveguide strip line transducer 46 is widened can be obtained.

In addition, as illustrated in FIG. 13A, among four tube walls of the transformer 47, a protrusion 51*b* is provided on an inner surface of a tube wall on the same side as the tube wall on which the protrusion 50 is provided, and a protrusion 51*a* is provided on an inner surface of a tube wall facing the tube wall on the same side as the tube wall on which the protrusion 50 is provided. For this reason, the waveguide strip line transducer 46 provided with the protrusion 50 can be matched with the circularly polarized wave generator input/output unit 48 provided with the protrusion 52.

Fifth Embodiment

In a fifth embodiment, a power feed circuit will be described in which the circularly polarized wave generator 61 and an antenna element 62 are connected to the power feed circuit of the fourth embodiment.

FIG. 14 is a cross-sectional view illustrating the power feed circuit according to the fifth embodiment of the present invention.

Figure 15:
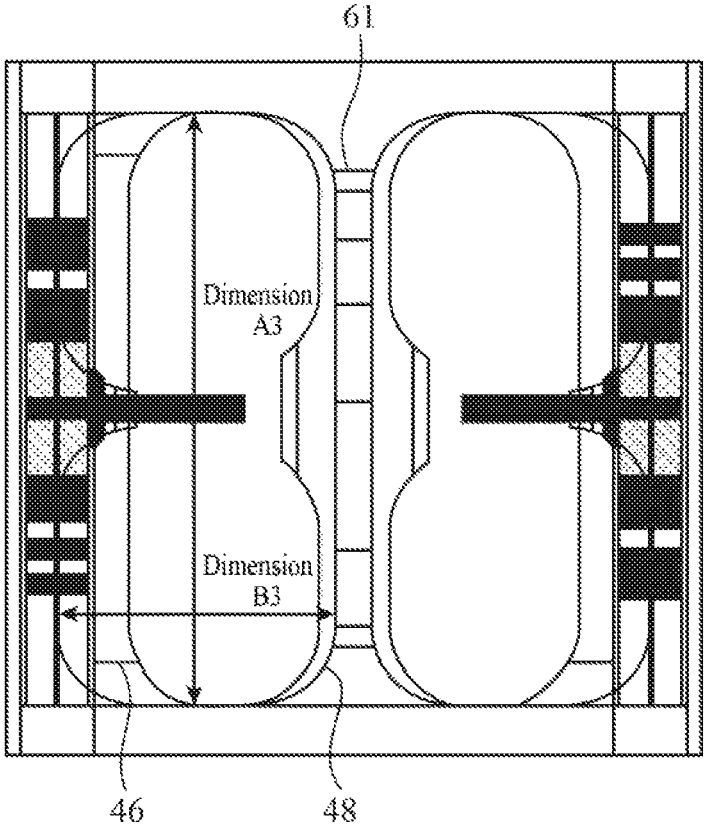
FIG. 15 is a top cross-sectional transparent view illustrating the power feed circuit according to the fifth embodiment of the present invention.

FIG. 15 is a top cross-sectional transparent view illustrating the power feed circuit according to the fifth embodiment of the present invention.

Figure 16:
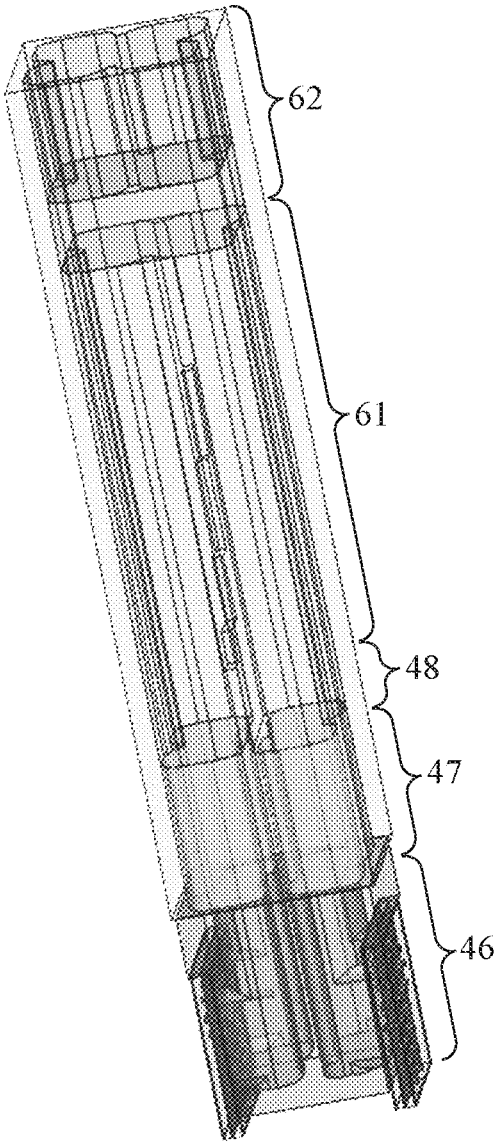
FIG. 16 is a perspective view illustrating the power feed circuit according to the fifth embodiment of the present invention.

FIG. 16 is a perspective view illustrating the power feed circuit according to the fifth embodiment of the present invention.

In FIGS. 14 to 16, since the same reference numerals as those in FIG. 11 denote the same or corresponding portions, the description thereof will be omitted.

The circularly polarized wave generator 61 is a septum for generating a circularly polarized wave.

The circularly polarized wave generator 61 has one end connected to the other end of the circularly polarized wave generator input/output unit 48, and another end connected to an antenna element 62 (FIGS. 14 and 16).

A tube diameter of the circularly polarized wave generator 61 is substantially the same as the tube diameter of the circularly polarized wave generator input/output unit 48.

The antenna element 62 radiates the circularly polarized wave output from the circularly polarized wave generator 61 to space, and receives a circularly polarized wave to output the received circularly polarized wave to the circularly polarized wave generator 61.

In the fifth embodiment, the tube diameter of the hollow waveguide 11 (shown in FIG. 1A) in the waveguide strip line transducer 46 is smaller than the tube diameter of the circularly polarized wave generator input/output unit 48 and the tube diameter of the circularly polarized wave generator 61.

As a result, in a case where an array antenna is formed by arraying a plurality of the power feed circuits each including the antenna element 62, the plurality of the antenna elements 62 can be arrayed without widening intervals between the plurality of power feed circuits.

Consequently, a footprint of the plurality of antenna elements 62 in the array antenna can be made small.

Note that, in the invention of the present application, within the scope of the invention, free combination of each embodiment, a modification of any component of each embodiment, or omission of any component in each embodiment can be made.

INDUSTRIAL APPLICABILITY

The present invention is suitable for a waveguide strip line transducer for inputting/outputting an electromagnetic wave and a power feed circuit on which the waveguide strip line transducer is mounted.

REFERENCE SIGNS LIST

1, 1*a*, 1*b*: Substrate, 2: Strip line, 3: First ground surface, 4: Second ground surface, 4*a*: Non-ground surface, 5, 6: End surface in tube axis direction of substrate 1, 11: Hollow waveguide, 11*a*: Opening of hollow waveguide 11, 11*b*: Tube interior of hollow waveguide 11, 12, 13, 14, 15: Tube wall, 16: Conductor, 16*a*: Extending portion, 17: Conductor, 17*a*: Back short, 18: BVH, 19: Probe, 19*a*: Tip of probe 19, 21: Impedance transforming unit, 22: Short-circuit stub, 23: Via hole, 31: First transducer group, 31*a*, 31*b*, 31*c*, 31*d*, 46: Waveguide strip line transducer, 32: Waveguide strip line transducer (second transducer), 33: Synthesizing and distributing circuit, 41, 42: First transducer group, 43, 44: Waveguide strip line transducer (second transducer), 45*a*, 45*b*, 45*c*, 45*d*, 46: Waveguide strip line transducer, 47: Transformer, 48: Circularly polarized wave generator input/output unit, 50, 51*a*, 51*b*, 52: Protrusion, 61: Circularly polarized wave generator, 62: Antenna element.

The invention claimed is:

1. A power feed circuit comprising:

at least one first transducer group;

a second transducer; and a synthesizing and distributing circuit;

wherein each of the at least one first transducer group includes an arrangement of two or more of a plurality of waveguide strip line transducers, and each of the plurality of waveguide strip line transducers includes:

a substrate including a strip line wired in an inner layer of the substrate, a first ground surface formed on a front surface of the substrate, and a second ground surface formed on a part of a back surface of the substrate;

a hollow waveguide having a rectangular cross-sectional shape formed by four tube walls, the substrate forming one tube wall of the four tube walls;

a via hole having one end connected to the strip line, and another end of the via hole arranged on a non-ground surface being a part of the back surface of the substrate on which the second ground surface is not formed, and a probe having one end connected to said another end of the via hole, and another end of the probe arranged at a position in a tube interior of the hollow waveguide;

wherein the second transducer includes one of the plurality of waveguide strip line transducers; and the synthesizing and distributing circuit connects the strip line of each of the plurality of waveguide strip line transducers included in the at least one first transducer group and the strip line of the waveguide strip line transducer included in the second transducer to each other, wherein M×N pieces of the plurality of waveguide strip line transducers are arranged in a two-dimensional plane by arranging M pieces of the at least one first transducer group each including the arrangement of N pieces of the plurality of waveguide strip line transducers, wherein M is an integer of 2 or more, and N is an integer of 2 or more, and among the M pieces of the at least one first transducer group, an n-th row waveguide strip line transducer included in the at least one first transducer group of m-th column, and an n-th row waveguide strip line transducer included in the at least one first transducer group of (m+1)-th column are connected to a same circularly polarized wave generator, wherein m is an integer of 1 or more and M−1 or less, and n is an integer of 1 or more and N or less.

2. The power feed circuit according to claim 1, wherein the synthesizing and distributing circuit connected to strip lines of the N pieces of the plurality of waveguide strip line transducers included in the at least one first transducer group of the m-th column, and a synthesizing and distributing circuit connected to strip lines of N pieces of the plurality of waveguide strip line transducers included in the at least one first transducer group of (m+1)-th column are formed in different layers, respectively, in the substrate.

3. A power feed circuit comprising:

a waveguide strip line transducer;

a transformer; and a circularly polarized wave generator input/output unit;

wherein the waveguide strip line transducer comprises:

a substrate including a strip line wired in an inner layer of the substrate, a first ground surface formed on a front surface of the substrate, and a second ground surface formed on a part of a back surface of the substrate;

a hollow waveguide having a rectangular cross-sectional shape formed by four tube walls, the substrate forming one tube wall of the four tube walls;

a via hole having one end connected to the strip line, and another end of the via hole arranged on a non-ground surface being a part of the back surface of the substrate on which the second ground surface is not formed;

a probe having one end connected to said another end of the via hole, and another end of the probe arranged at a position in a tube interior of the hollow waveguide; and a second conductor bonded to an end surface of the substrate;

wherein the transformer has one end connected to one end of the hollow waveguide in the waveguide strip line transducer, wherein the circularly polarized wave generator input/output unit has one end connected to another end of the transformer, and another end connected to one end of a circularly polarized wave generator, and wherein a tube diameter of the hollow waveguide is smaller than a tube diameter of the circularly polarized wave generator input/output unit.

4. The power feed circuit according to claim 3, wherein the via hole is a blind via hole.

5. The power feed circuit according to claim 3, further comprising:

a first protrusion of the hollow waveguide provided on an inner surface of a tube wall facing the tube wall for which the substrate is used, among the four tube walls of the hollow waveguide, a second protrusion of the transducer provided on an inner surface of a tube wall on a same side to a side of the tube wall on which the first protrusion of the hollow waveguide is provided, and another protrusion of the transducer is provided on an inner surface of a tube wall facing the tube wall on the same side, among four tube walls of the transformer, and a third protrusion of the circularly polarized wave generator input/output unit provided on an inner surface of a tube wall on a side facing the side of the tube wall on which the first protrusion of the hollow waveguide is provided, among four tube walls of the circularly polarized wave generator input/output unit.

6. The power feed circuit according to claim 3, further comprising:

the circularly polarized wave generator having the one end connected to the another end of the circularly polarized wave generator input/output unit, wherein the tube diameter of the hollow waveguide is smaller than a tube diameter of the transformer, and the tube diameter of the transformer is smaller than each of the tube diameter of the circularly polarized wave generator input/output unit and a tube diameter of the circularly polarized wave generator.

7. A waveguide strip line transducer comprising:

a substrate including a strip line wired in an inner layer of the substrate, a first ground surface formed on a front surface of the substrate, and a second ground surface formed on a part of a back surface of the substrate;

a hollow waveguide having a rectangular cross-sectional shape formed by four tube walls, the substrate forming one tube wall of the four tube walls;

a via hole having one end connected to the strip line, and another end of the via hole arranged on a non-ground surface being a part of the back surface of the substrate on which the second ground surface is not formed;

a probe having one end connected to the another end of the via hole, and another end of the probe arranged at a position in a tube interior of the hollow waveguide; and a second conductor bonded to an end surface of the substrate, wherein one tube opening of two tube openings of the hollow waveguide is closed with a conductor, wherein a matching element adjusting an impedance of the probe is connected to the strip line, and wherein the matching element is connected to the strip line in a portion between a position where the via hole is provided and a position where the conductor by which the one tube opening is closed is provided.

8. The waveguide strip line transducer according to claim 7, wherein an end surface on an opening side of the hollow waveguide is shielded by a second conductor, and where the end surface of the substrate being shielded by the second conductor.

9. The waveguide strip line transducer according to claim 8, wherein a conductor plate having a cross-sectional shape, which is the same as the shape of the hollow waveguide is sandwiched between the substrate and the second conductor, which together form the one tube wall of the hollow waveguide.

10. The waveguide strip line transducer according to claim 8, wherein the second conductor, bonded to the end surface of the substrate on the opening side of the hollow waveguide, is connected to the second ground surface to cover a part of the second ground surface formed on the back surface of the substrate.

11. The waveguide strip line transducer according to claim 7, further comprising a protrusion provided on an inner surface of a tube wall facing the tube wall formed by the substrate.

12. The waveguide strip line transducer according to claim 7, wherein the matching element includes:

an impedance transforming unit widening a line width of the strip line, and a short-circuit stub having one end connected to the strip line and another end short-circuited.

13. The waveguide strip line transducer according to claim 7, wherein the via hole is a blind via hole.

* * * * *